US006463235B1

(12) United States Patent
Yamanaka et al.

(10) Patent No.: US 6,463,235 B1
(45) Date of Patent: Oct. 8, 2002

(54) LIGHT-SENSITIVE DRUM MOUNTING/ DEMOUNTING STRUCTURE, LIGHT-SENSITIVE UNIT PROVIDED WITH THE SAME STRUCTURE AND IMAGE-FORMING DEVICE WITH THE SAME UNIT

(75) Inventors: Toshio Yamanaka, Yao; Hideaki Kadowaki, Yamatokoriyama; Yoshiya Kinoshita; Naoyuki Harada, both of Nara, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/542,285

(22) Filed: Apr. 4, 2000

(30) Foreign Application Priority Data

May 31, 1999 (JP) ..... 11-152899
Dec. 24, 1999 (JP) ..... 11-366935

(51) Int. Cl.[7] ..... G03G 15/00
(52) U.S. Cl. ..... 399/117
(58) Field of Search ..... 399/117, 116, 399/113, 107

(56) References Cited

U.S. PATENT DOCUMENTS 6,198,891 B1 * 3/2001 Ishida et al. ..... 399/117

FOREIGN PATENT DOCUMENTS

| | | |
|---|---|---|
| JP | 63267989 A | 4/1988 |
| JP | 157772 U | 4/1989 |
| JP | 7199650 | 8/1995 |

* cited by examiner

*Primary Examiner*—Quana M. Grainger

(57) ABSTRACT

A light-sensitive unit used in an image-forming device such as an electrostatic copier or printer, which enables one to easily mount and demount a light-sensitive drum without removing an electrically charging device and with no fear of damaging an edge of a cleaning blade. A second process unit (light-sensitive unit) has a resin-made frame having a cleaning device and includes a light-sensitive drum and an electrically charging device, which are removably mounted therein respectively. The light-sensitive drum is mounted in the frame by first axially inserting its rear-end bearing portion into a rear-side drum-holder and by horizontally turning its front-end bearing portion and placing it in a front-side drum-holder along a guide groove provided in the side thereof. Finally, a stopper is fitted in the front-side drum-holder to prevent the drum from slipping out of the holder.

8 Claims, 22 Drawing Sheets

LIGHT-SENSITIVE DRUM MOUNTING/DEMOUNTING STRUCTURE, LIGHT-SENSITIVE UNIT PROVIDED WITH THE SAME STRUCTURE AND IMAGE-FORMING DEVICE WITH THE SAME UNIT

BACKGROUND OF THE INVENTION

The present invention relates to a structural means for mounting and demounting a light-sensitive drum used in an image-forming apparatus such as an electro-static copier or printer, a light-sensitive unit provided with the mounting/demounting structural means and an image forming device including the same light-sensitive drum unit with the same mounting/demounting structural means.

Typically, a light-sensitive body used in an image-forming apparatus such as an electro-photographic copying machine or printer is a light-sensitive drum having a supporting shaft, which can be mounted/removed to/from the apparatus by axially sliding it along the supporting shaft. The light-sensitive drum is placed rotatably in the apparatus body in such a way that it engages its supporting shaft ends with driving mechanism of the apparatus and it also engages a gear formed at a light-sensitive body flange with a driving gear of the apparatus's driving mechanism. This mounting/demounting structure requires the user to mount or demount the light-sensitive body by positioning the ends of its shaft with respect to the driving mechanism of the apparatus. The use of this structure results in elongation of the light-sensitive body and increasing its weight. The light-sensitive drum unit cannot be easily handled.

Several structural means for mounting and demounting a light sensitive drum in a conventional image-forming device such as a conventional electro-static copying machine or printer have been proposed. Typically, Japanese Laid-Open Utility Model Publication No. 1-57772 discloses a light-sensitive drum of the type that a light-sensitive unit consisting of a light-sensitive drum and a cleaning device unitarily formed with a supporting member is separately formed from an electro-charging device and the drum is mounted downward onto or removed upward from the supporting member in the image-forming device. Japanese Laid-Open Patent Publication No. 63-267989 discloses an image forming device in which a light sensitive drum can be moved along a horizontal guide rail attached to a supporting member of the light sensitive drum to a given position and fixed thereat.

The first prior art (Japanese Laid-Open Utility Model Publication No.1-57772) describes a light-sensitive unit consisting of a light-sensitive drum and a cleaning device integrally formed thereon, which is supported by a supporting member having a concave section opposite to an end face of the drum and being perpendicular to an axial line of the end face of the drum. This concave section allows the user to easily mount and remove the light-sensitive drum (downward) from the upper side of the device where an electrically charging device is located.

The second prior art (Japanese Laid-Open Patent Publication No.63-267989) teaches a guide rail that is swingably attached to a supporting member of a light-sensitive drum and, when mounting or demounting the light-sensitive drum, can be turned from a normal vertical position to a horizontal position. In the horizontal state, it can rotate and carry the supporting shaft of the light-sensitive drum along the guide rail. This allows the user to easily mount the light-sensitive drum in the horizontal state in the device. Furthermore, turning the guide rail actuates means for detaching the supporting shaft from a driving mechanism, making easier the removal of the light-sensitive drum.

In the light-sensitive drum unit unitarily constructed of a light-sensitive drum, an electrically charging device and a cleaning device, the light-sensitive drum must be mounted or removed with care not to damage by collision the working surfaces of the drum, the charger and a blade of the cleaning device. The light-sensitive drum can be easily downsized as compared with the charger, developing device, transferring device and cleaning device surrounding the drum. However, it is difficult for a user to mount or remove a small drum due to irrevocable interference between the frame and own fingers.

The prior art disclosed in Japanese Laid-Open Utility Model Publication No.1-57772 can mount/demount the light-sensitive drum from the upper side of a light-sensitive unit separately formed from an electrostatic charger but cannot realize the same in a light-sensitive unit constructed unitarily with the charger. Namely, the prior art requires the provision of a separate charger that must be replaced to a refuge position before mounting/demounting the light-sensitive drum. This requires the user to do additional complicated work.

The prior art disclosed in Japanese Laid-Open Patent Publication No. 63-267989 merely refers to mounting and demounting of a light-sensitive drum in a horizontal state and does not consider devices disposed around the drum. Especially for the light-sensitive unit formed unitarily with the charger and the cleaning device having a cleaning blade, it is essential to take care not to damage, by colliding the drum and charger, the light sensitive surface of the drum and cleaning edge of the cleaning blade when mounting/demounting the drum from the unit. The prior art disclosed in Japanese Laid-Open Patent Publication No. 63-267989 describes merely the fact that the light-sensitive drum is placed and removed in the horizontal state. There is no description relating how to mount the light-sensitive drum with respect to the surrounding devices. No description is found whether the drum can be replaced without previously removing the charger and with no fear of damaging the working surface of the drum and grids of the charger.

SUMMARY OF THE INVENTION

The present invention relates to structural means for mounting and demounting a light-sensitive drum in an image-forming device such as a copying machine and a printer, a light-sensitive body unit provided with the same structural means and an image-forming device provided with the same light-sensitive body unit with the same structural means. Specifically, this invention refers to a light-sensitive drum mounting/demounting structure allowing one to mount the drum in a frame of a light-sensitive drum with no fear of damaging its light-sensitive body; a light-sensitive unit that can integrally support a cleaning device, an electrically charging device and a light sensitive drum and allows at least the light-sensitive drum to be removably mounted on its frame; and a image forming device incorporating the light-sensitive body unit.

An object of the present invention is to provide a simple structure for easily mounting and demounting a light-sensitive drum with no need of demounting an electrically charging device in advance and with no fear of damaging the light-sensitive surface of the drum and a cleaning blade edge.

Another object of the present invention is to provide a structure for easily mounting and demounting a light-sensitive drum in and from a frame of a light-sensitive unit by holding the drum with fingers.

A further object of the present invention is to provide a structure for mounting/demounting a light-sensitive drum in/from a frame of a light-sensitive body unit without decreasing the strength of the supporting member and increasing the size thereof.

The above-mentioned drawbacks of the prior arts are solved by the following technical means provided by the present invention.

The first technical means is a light-sensitive drum mounting/demounting structure for removably supporting in its frame a light-sensitive drum bearing a latent electrostatic image formed on its cylindrical surface, which structure is provided with regulating means for preventing the light-sensitive surface of the drum from contacting the other members arranged around the drum when mounting the latter into the frame.

The second technical means is the light-sensitive drum mounting/demounting structure as defined by the first technical means, which is featured by the frame having a pair of holders disposed opposite to each other with the drum between them and supporting the respective ends of the drum shaft and by use of the regulating means for restricting the movement of the supporting shaft.

The third technical means is the light-sensitive drum mounting/demounting structure as defined by the second technical means, which is featured in that one holder of the paired holders has a throughout hole made therein for inserting the supporting shaft of the light-sensitive drum and the regulating means is a bearing portion formed as an axially protrusion of the inner wall of the through hole (cylinder) to receive the end of supporting shaft of the light-sensitive drum.

The fourth technical means is a light-sensitive drum mounting/demounting structure for removably supporting in its frame the light-sensitive drum bearing a latent electrostatic image formed on its external cylindrical surface, which structure is provided with a finger-relief notch formed in the frame portion adjacent to a space through which the light-sensitive drum is mounted/removed in/from the frame.

The fifth technical means is the light-sensitive drum mounting/demounting structure as defined by the third or fourth technical means, which is featured in that one of the paired holders has a stopper removably fit in its side wall thereof and a guide formed in the same place with the stopper removed for guiding the supporting shaft of the light-sensitive drum to be mounted in the same holder.

The sixth technical means is a light-sensitive body unit provided with any one of the light-sensitive drum mounting/demounting structures of the technical means 1 to 5.

The seventh technical means is a light-sensitive unit having a frame for unitarily holding a cleaning device having a blade for scrapping off toner from the light-sensitive drum surface, an electrically charging device and an at least removable light-sensitive drum, which unit is so constructed that a frictional force acting on the cleaning blade edge being in contact with the cylindrical surface of the light-sensitive drum when mounting the latter in the frame is directed toward the cleaning edge from the supporting member and the light-sensitive drum is mounted from the direction where it cannot touch the electrically charging device.

The eighth technical means is a light-sensitive body unit having a frame for unitarily holding a cleaning device having a blade for scraping toner from the light-sensitive drum surface, an electrically charging device and an at least removable light-sensitive drum, which is so constructed that the light-sensitive drum is axially inserted at its one end in an holder disposed at one end of the frame and is sideward inserted at the other end in a holder disposed at the other end by horizontally turning the latter end of the drum relative to its former end.

The ninth technical means is a light-sensitive body unit as defined by any one of the technical means 7 and 8, which is featured in that its frame has a base to be placed on a working surface in such a way that light-sensitive drum can be mounted or removed from the upper diagonal direction.

The tenth technical means is a light-sensitive body unit as defined by the technical means 8, which is featured in that the holder disposed at one end of the frame supports one end of the light-sensitive drum and a locating block of an image-forming device when the light-sensitive body unit is mounted in the image-forming device.

The eleventh technical means is an image-forming device provided with a light-sensitive drum mounting/demounting structure defined by any one of the technical means 1 to 5 or a light-sensitive body unit defined by any one of the technical means 6 to 10.

PREFERRED EMBODIMENTS OF THE INVENTION

Referring to the accompanying drawings (FIGS. 1 to 22), preferred embodiments of the present invention will be described bellow in detail. Note FIG. 8 is conventional art.

Figure 1:
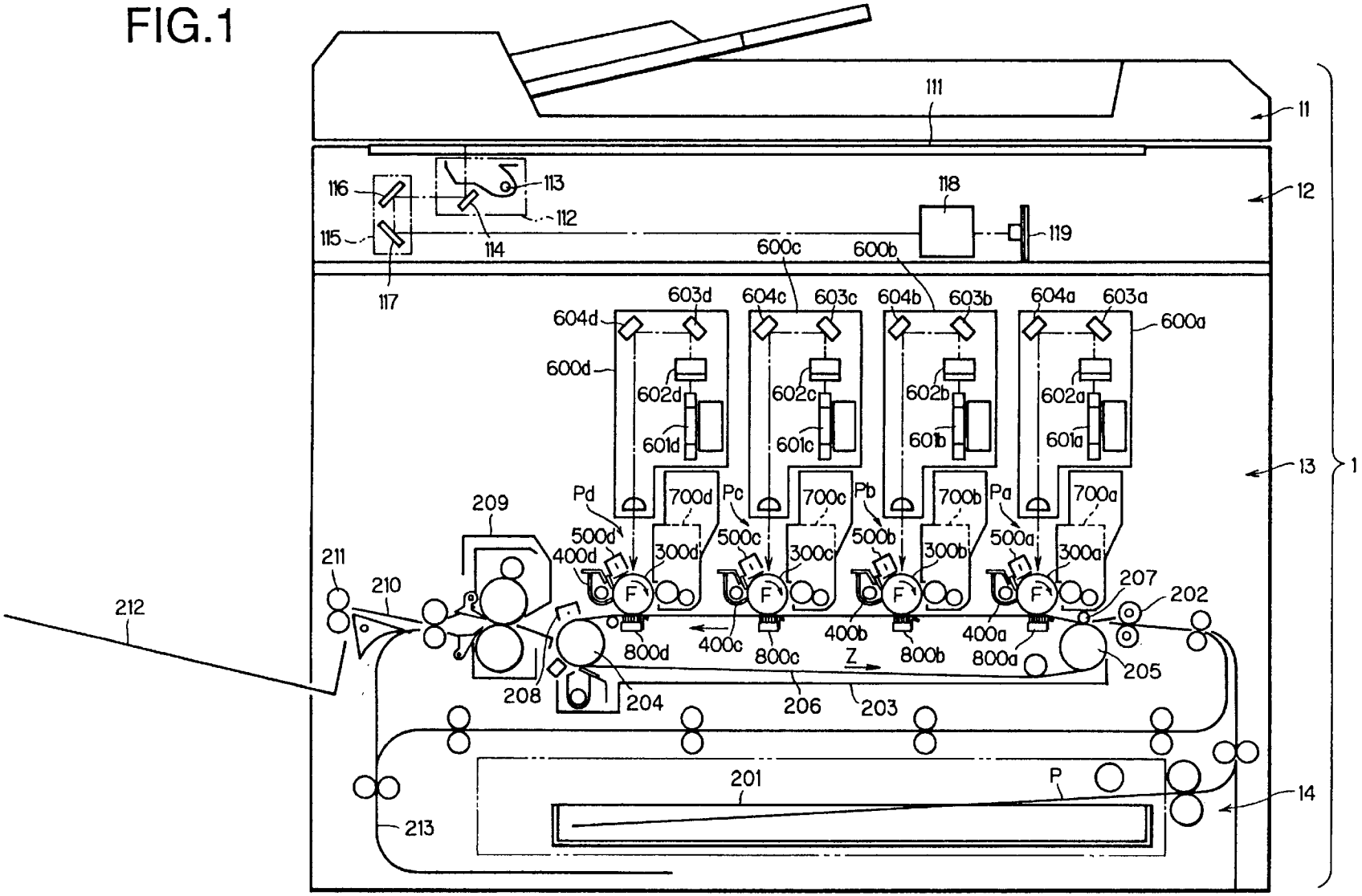
FIG. 1 is a front internal construction view of a digital color-image copying machine using a light-sensitive body (the second process unit) embodying the present invention.

FIG. 1 is a front internal view of a digital color-image copying machine using a light-sensitive unit embodying the present invention.

As shown in FIG. 1, the copying machine has a main body (copier housing) 1 that incorporates mainly a reversing automatic document feeder (RADF) 11, an image-reading section 12, an image-forming section 13 and a paper-feeding device 14.

The copier main body 1 has at its top a document table 111 and a control panel (not shown) and incorporates an image-reading section 12 and the image-forming section 13. The document table 111 is provided at its top with the reversing automatic document feeder (RADF) 11 that can be open and close with respect to the document table and is mounted in a given position relative to the document table.

This document feeder (RADF) 11 is designed to feed an original document sheet to the document table 111 in such a manner that one side of the original is placed on a given position of the document table opposite to the image-reading section 12. On completion of reading that side of the original by the image-reading section 12, the document feeder 11 turns over the original and feeds it again to the given position of the document table 111 to place the other side of the original document opposite to the document reader 12. When images on both surfaces of the original were read, the document feeder 11 delivers the original out of the copier and, then, begins feeding of a next original to the document table. The above document feeding and reversing operation is controlled in accord with an entire system operation of the copying machine.

The image-reading section 12 is disposed below the document table 111 to read an image on an original transported by the document feeder 11. This image-reading section 12 includes an original image scanners 112 and 115 each being capable of reciprocally sliding along the bottom surface of the document table 111, an optical lens 118 and a charge coupled device (CCD) type line sensor 119 being a photo-electric converting element.

The original image scanner 112 forms a first scanning unit and the original image scanner 115 forms a second scanning unit. The first scanning unit (original image scanner) 112 has a exposure lamp 113 for illuminating the image on the surface of an original image and a first mirror 114 for reflecting a light image from the original in a given direction. It reciprocally travels at a specified speed in a horizontal direction along the bottom surface of the document table, keeping a constant distance from there. The second scanning unit (original image scanner) 115 has a second mirror 116 and a third mirror 117 that receive the original image light reflected from the first mirror 114 of the first scanning unit 112 and further reflect the light in respective given directions. The second scanning unit 115 reciprocally travels parallel with the first scanning unit 112 keeping a constant speed relative to the speed of the first scanning unit 112.

The optical lens 118 reduces the size of the original image light reflected from the third mirror 117 of the second scanning unit 115 and focuses the light of the contracted image on a given position of the CCD line sensor 119.

The CCD line sensor 119 photo-electrically converts focused light of the image into a series of output electrical signals. The CCD line sensor 119 is a three-line color charge-coupled device (CCD) that can read a monochromatic image or a color image, decompose it to color components R(Red), G(Green) and B(Blue) and output data of three lines. The series of electrical signals representing the original image information is further transferred from the line sensor 119 to an image processing section (not shown) for further necessary processing.

The construction of the image-forming section 13 is now described below.

The image-forming section 13 is provided in its lower portion with a paper-feeding device 14 that feeds separately a sheet of copy paper (recording medium) P from paper sheets piled on a tray 201 to the image-forming section 114. A separate paper sheet P is transported to the image forming section 13 with due timing control by a pair of register rollers 202 disposed close to an inlet of the image-forming section 13. The paper sheet P having an image printed on one side is transported again to the image-forming section 13 in accord with the timing control of the image-forming section 13.

In the lower portion of the image-forming section 13 is a transfer belt mechanism 203 that comprises a transfer endless belt 206 engagingly stretched between a driving roller 204 and a driven roller 205, a charger 207 for electrically charging a paper sheet and a discharger 208. The transfer belt device 206 transports a paper sheet P electro-statically adhering to its belt.

The paper charger 207 disposed between the first image-forming station Pa and the paper feeding mechanism 14 forces the paper sheet P fed by the register rollers 202 to be electrically charged in the state pinched between the charger 207 and the surface of the transfer belt 206. The paper sheet P fed from the paper feeding mechanism 14 persistently adheres to the transfer belt 206 by the effect of electrostatic force produced between them and reliably transported by the transfer belt 206 through the first to fourth image-forming stations Pa–Pd.

A discharger 208 disposed just above the driving roller 204 between fourth image-forming station Pb and a fixing device 209 is supplied with an alternate current to separate the paper sheet P from the transfer belt 206 by the effect of corona discharge.

A fixing device 209 for fixing a toner image formed on the paper sheet P is arranged further downstream from the discharger 208 of the transfer belt mechanism 203 in a path for delivering papers. The paper sheet P passes through a nip between paired fixing rollers of the fixing device 209 and a switching gate 210, then it is delivered by outlet rollers 211 to an outlet tray 212 attached to the external wall of the copier housing 1.

A switching gate 210 is intended to selectively switch a path from the fixing device 209 to a path for delivering the paper sheet P to the outlet tray or a path for returning it to the image-forming section 13. The paper sheet P directed by the switching gate 210 to the image-forming section 13 is reverse directed with its rear edge forward by a switchback-transporting path 213. It is further turned upside down during transportation to register rollers 202 and fed again to the image-forming section 13.

In the image-forming section 13, the image-forming stations No. 1 (Pa) to No.4 (Pd) are arranged in parallel to each other and closely above the transfer belt 206 in the described order from the upstream side.

Transfer belt 206 is frictionally driven in the direction shown by arrow Z (FIG. 1) by the driving roller 204. It holds a paper sheet P fed from the paper-feeding device 14 and transports the paper sheet P to the image-forming stations Pa–Pd subsequently.

The image-forming stations Pa–Pd have the substantially same structure. Their light-sensitive drums 300*a*, 300*b*, 300*c* and 300*d* are driven in directions shown by arrows F in FIG. 1.

Each of the light-sensitive drums 300*a*–300*d* is surrounded by a cleaning device 400*a*–400*d* for scrapping off toner remaining on the drum surface, a charger 500*a*–500*d* for evenly charging a working surface of the light-sensitive drums 300*a*–300*d*, a developing device 700*a*–700*d* for developing with toner an electrostatic latent image formed on the surface of the light-sensitive drums 300*a*–300*d* and a transfer discharger 800*a*–800*d* for transferring the developed toner image on the light-sensitive drums 300*a*–300*d* onto a paper sheet P. The above devices are arranged around the light-sensitive drum (300*a*–300*d*) in the described order in the rotational direction of the drum. Above each light-sensitive drum (300*a*–300*d*) is a laser-beam scanner unit (hereinafter referred to as LCU) 600*a*–600*d*, which is composed of a semiconductor laser element (not shown) for generating dotted light modulated by image data, a polygonal mirror (deflecting device) 601*a*–601*d* for deflecting a laser beam from the semiconductor laser element in the main scanning direction, a lens f θ (602*a*–602*d*) and mirrors (603*a*–603*d*, 604*a*–604*d*) for forming an image on a surface of the light-sensitive drum (300*a*–300*d*).

The LSU 600*a* receives an image signal corresponding to a black color image component of an original color image, the LSU 600*b* receives an image signal corresponding to a cyan color image component, the LSU 600*c* receives an image signal corresponding to a magenta color image component and the LSU 600*d* receives a yellow color image component.

Latent images corresponding to color-converted image-information of an original image by the above way is formed on respective light-sensitive drums 300*a*–300*d*. The developing device 700*a* stores black toner, the developing device 700*b* stores cyan color toner, the developing device 700*c* stores magenta color toner and the developing device 700*d* stores yellow toner. The latent images formed on the respective light-sensitive drums 300*a*–300*d* are developed with toner stored in the respective developing devices 700*a*–700*d*. The original image information is converted by the image-forming section 13 to color component images that are thus reproduced as respective color toner images by the respective developing devices.

In the thus constructed digital color copier, cut sheets of paper are used as copy paper sheets P. A copy sheet P is fed from a paper sheet cassette 201 into a guide of a paper transporting path of the paper-feeding mechanism 14 and its front edge is detected by a sensor (not shown) that in turn generates a detection signal to paired register rollers 202 for temporally stopping the paper sheet P.

The paper sheet P is then sent onto the transfer belt 206 rotating in the direction shown by arrow Z in FIG. 1 in synchronism with the operation of each of the image-forming stations Pa–Pd. Since the paper sheet P is electrically charged by the charger 207 to adhere to the transfer belt 206 with an electrostatic force generated between them, it is stably transported by the transfer belt 206 while passing through each of the image-forming stations Pa–Pd.

At each of the image-forming stations Pa–Pd, the respective color-toner images are formed and transferred subsequently onto the paper sheet P adhering to the transfer belt 206. On completion of transferring the last toner image at the fourth image forming station Pd, the paper sheet P is separated from the transfer belt 206 by removing the electric charge therefrom by the discharger 208 and led to the developing device 209. The paper sheet P with the color image fixed by heat thereon is delivered through a paper outlet (not shown) onto a delivery tray 212.

According to the above explanation, the LSUs 600*a*–600*d* are used to write light images scanning with laser beams on the light-sensitive surfaces of the light-sensitive body. It is also possible to use, in replace of the LSUs, optical writing system (LED heads) each composed of an array of light-emitting diodes and a lens array. The LED head is smaller than the LSU and has no moving part, emitting no sound. Therefore, the LED heads are suitable to use in tandem type digital color copiers that have to use a plurality of light writing units.

Figure 2:
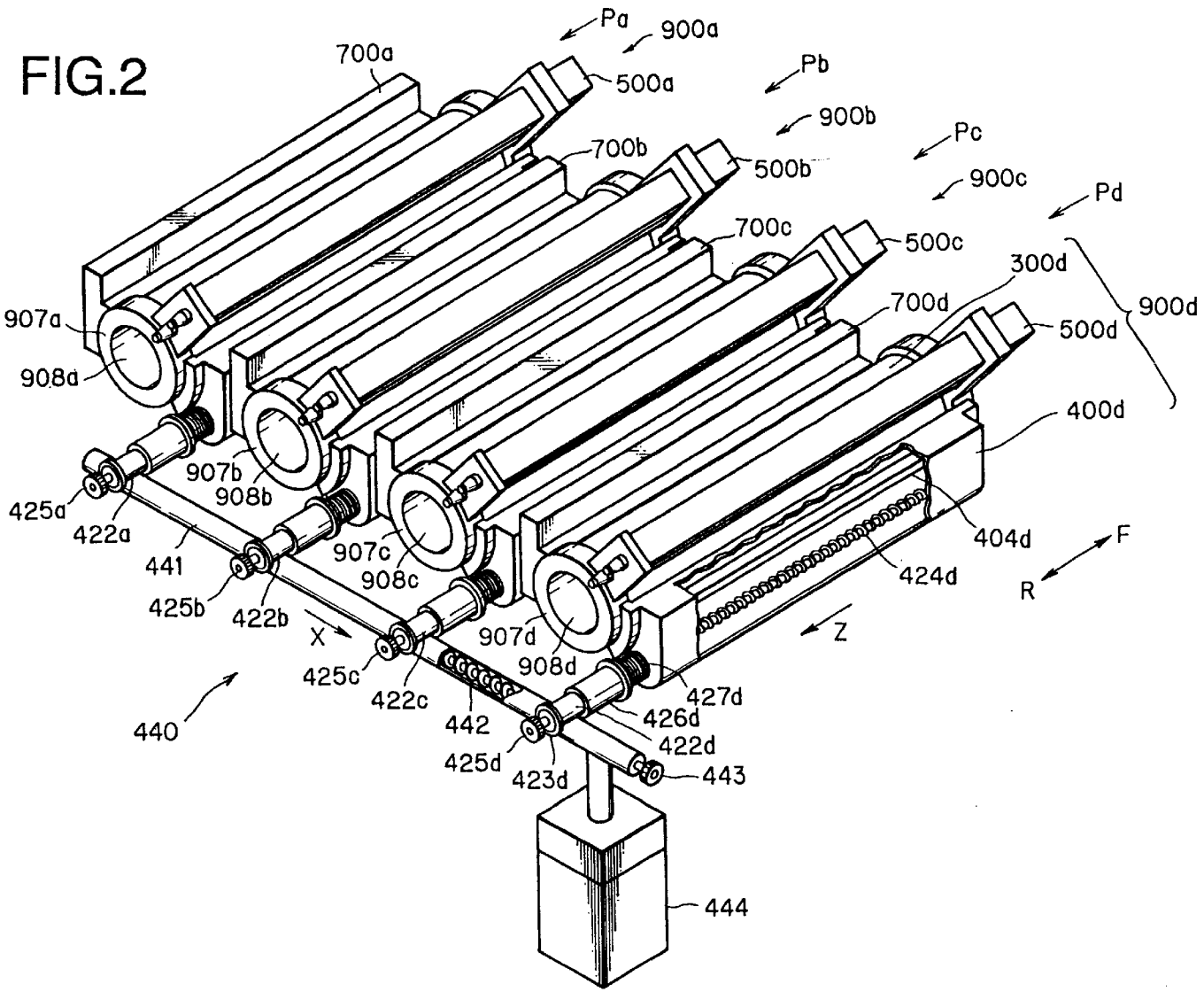
FIG. 2 is a perspective illustration of four image stations Pa–Pd viewed from the rear side of a copying machine.

Referring now to FIGS. 2 to 10, a structure to which present invention relates will be described as follows:

FIG. 2 illustrates four image-forming stations Pa–Pd viewed in perspective from the rear side of the copier housing 1 shown in FIG. 1.

Each image-forming station Pa–Pd is composed of two removable process units for the copier housing 1. The first process units are developing units 700*a*–700*d*. The second process units 900*a*–900*d* are light-sensitive body units having a resin-made frames 901*a*–900*d* that have cleaning devices 400*a*–400*d* unitarily formed therewith and includes a light-sensitive drums 300*a*–300*d* and chargers 500*a*–500*d* removably attached thereto to form an integral process unit. The first process units (developing devices) 700*a*–700*d* and the second process units 900*a*–900*d* are removably mounted on a moving frame 159 that is movable in directions F and R (FIG. 2) on a rear supporting frame 151 (FIG. 20) of the copier housing 1. (The direction F is the direction from the rear side of the copier housing 1 to the front side thereof while the direction R is the direction from the front side of the copier housing 1 to the rear side thereof.)

The first process units (developing devices) 700*a*–700*d* and the second process units 900*a*–900*d* can be removed out of the copier housing 1 when they have been moved to the limit in the direction F. The first process units 700*a*–700*d* and the second process units 900*a*–900*d* can be mounted in respective working positions in the copier housing 1 when they have been pushed to the limit in the direction R. In these positions, they are ready to work for forming images.

The following description relates to details of the second process unit 900*d* that is representative of four units 900*a*–900*d* having the same structure.

Assume that all first and second process units (700*a*–700*d* and 900*a*–900*d*) have been mounted in the working positions as shown in FIG. 2. The cleaning device 400*d* in the second process unit 900*d* collects toner particles (developing agent) scraped from the light-sensitive drum 300*d* by its cleaning blade 404*d* and transports them in the direction shown by arrow Z by means of a screw-conveyer 424*d* to a toner discharging device 440 commonly used by the cleaning devices 400*a*–400*d*. For example, in the discharging device 440, toner particles from the cleaning device 400*d* is further transported in the direction shown by arrow X by a second toner screw-conveyer 442 driven from a driving gear 443 in a transporting pipe 441 and discharged into waste toner box 444 connected to the toner transporting pipe 441.

In the process of inserting the second process units 900*a*–900*d* in the direction R (FIG. 2) into the copier housing 1, a slide shutter 426*d* closing a discharge port (not shown) of the toner transporting pipe 422*d* moves against the force of a spring 427*d* in the direction F. When the second process units are inserted to the limit in the direction R, the discharge port (not shown) of the toner transporting pipe 422*d* and receiving port of the toner transporting pipe 441 meet to each other to communicate the toner transporting pipe 422*d* with the toner transporting pipe 441. At the same time, the driving gear 425*d* for rotating the screw conveyer 424*d* engages with a gear of the copier housing 1. Driving means (driving shaft 155 in FIG. 20) for rotating the light-sensitive drum 300*d* moves into a through hole 908 made in rear-side drum holder 907*d* at a rear end of a frame 901*d* of the second process unit 900*d*. The light-sensitive drum 300*d* loosely supported in the second process unit 900*d* is now located in a given position and can be driven by the driving shaft 155.

Referring to FIGS. 3 to 5 and FIGS. 9 to 12, the second process unit 900*d* is further described in detail. Numerals may sometimes lack suffix "d" in the description with reference to FIGS. 3 to 12 and FIGS. 16 to 22.

Figure 3:
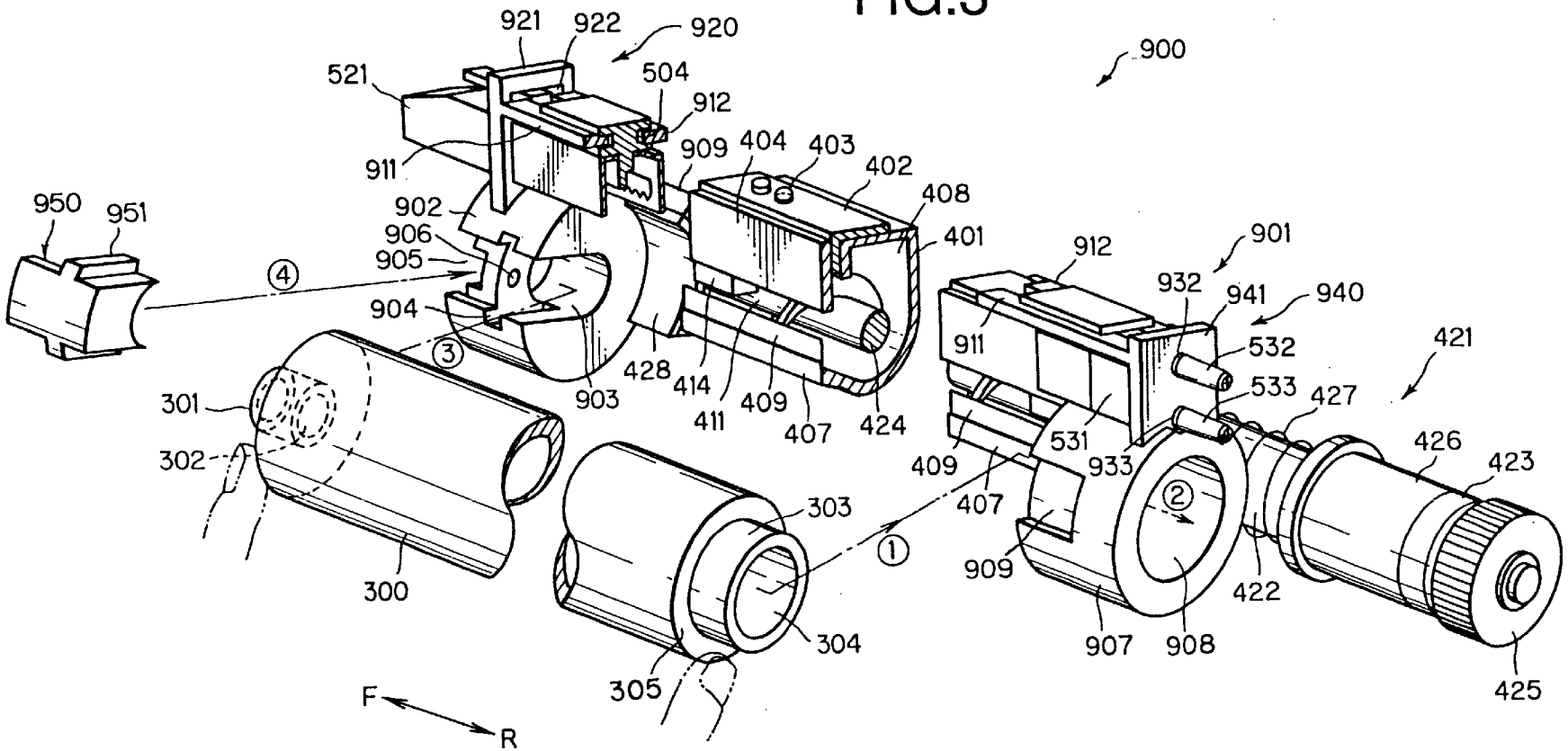
FIG. 3 is a perspective illustration of a light-sensitive unit in which a light-sensitive drum is not yet mounted from the rear side of the unit.
Figure 4:
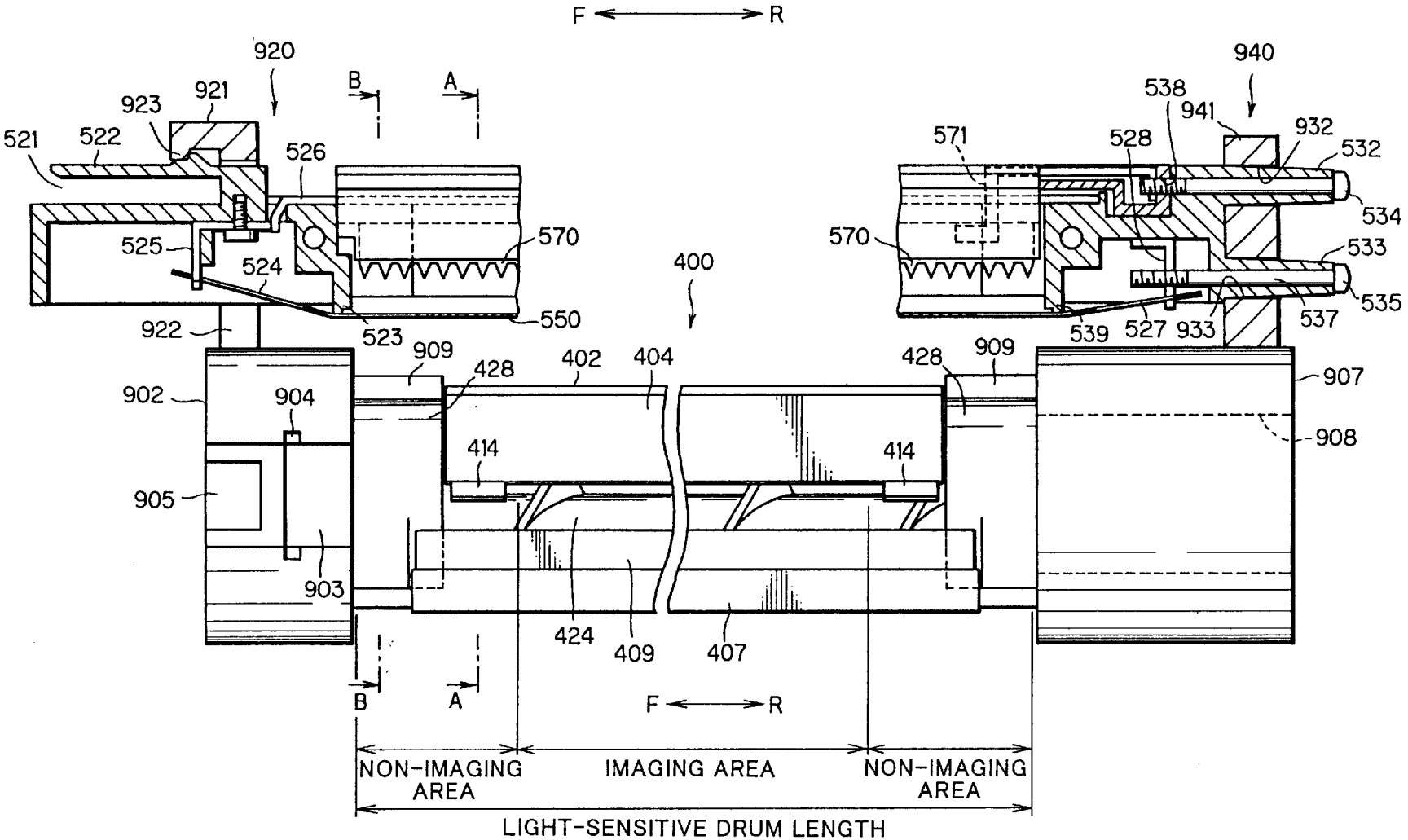
FIG. 4 is a sectional illustration of an essential section of the light-sensitive unit of FIG. 3, viewed from the side of a light-sensitive drum (not shown).
Figure 9:
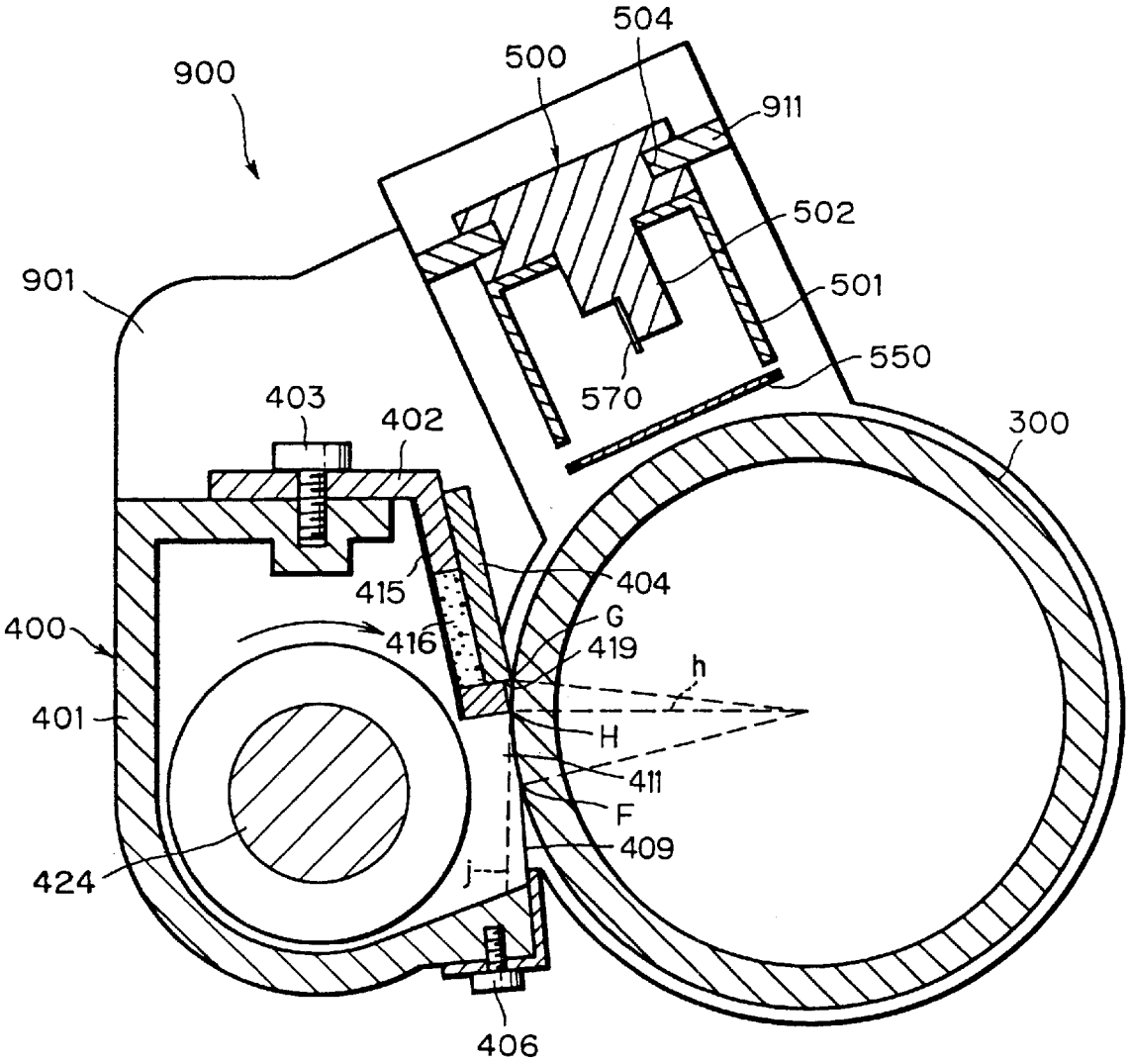
FIG. 9 is a section taken on line A—A in FIG. 4.
Figure 10:
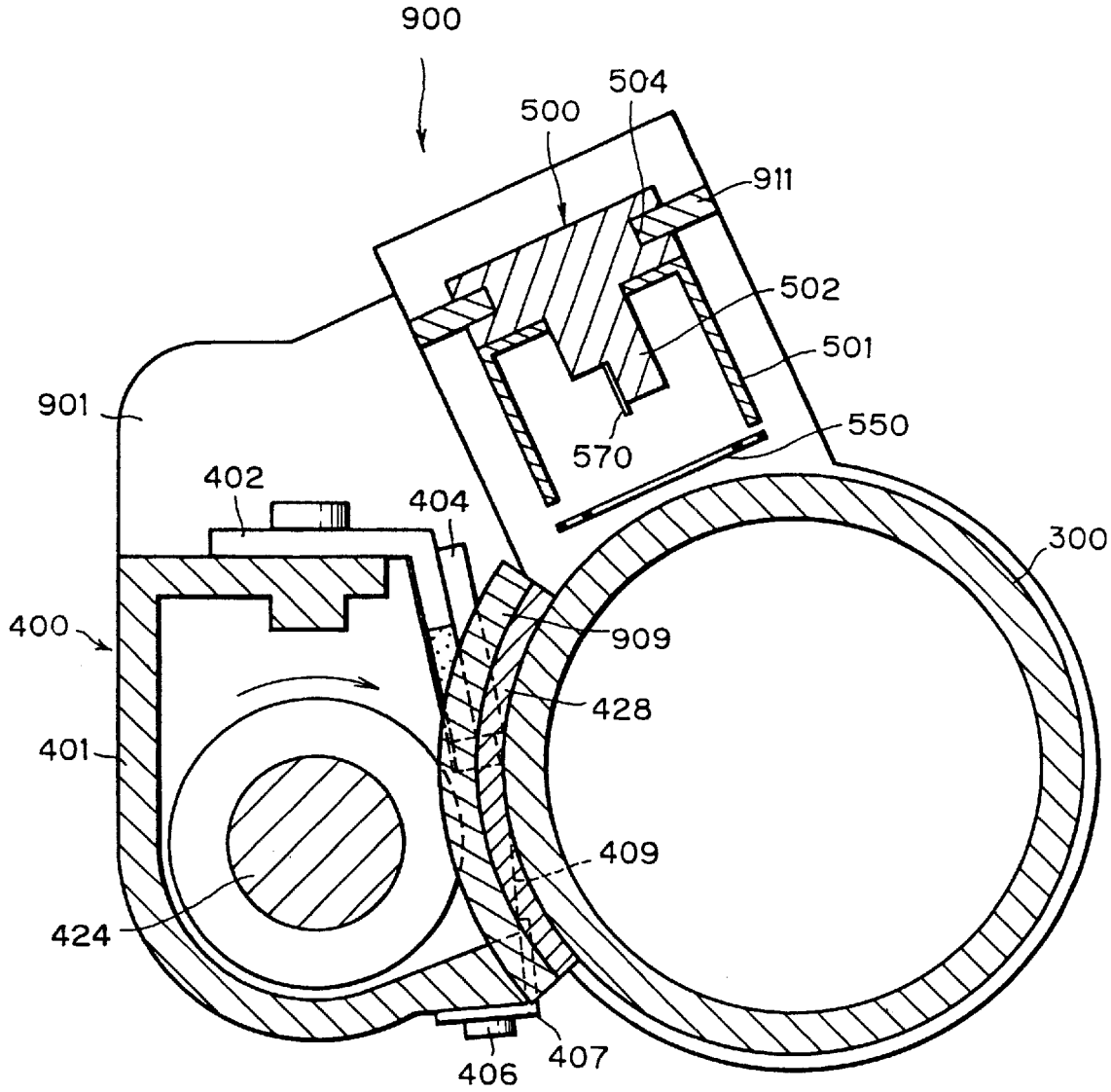
FIG. 10 is a section taken on line B—B in FIG. 4.

FIG. 3 is a perspective view of a second process unit 900 without a light-sensitive drum when viewing it from the rear side thereof. FIG. 4 is a sectional view of an essential portion of the second process unit 900 when viewing it from the light-sensitive drum side (however, the drum is not shown). FIGS. 9 and 10 are sections taken on lines A—A and B—B respectively in FIG. 4.

As shown in FIG. 3, the second process unit 900 has a resin-made frame 901 unitarily formed with a front-side drum holder 902 (at the F-side end in FIG. 3), a rear-side drum holder 907 (at the R-side end), a cleaner portion 401 between the front-side drum holder 902 and the rear-side drum holder 907, connectors 909, 909 for connecting the cleaner portion 401 with the drum-holders 902 and 907, a transporting portion 421, front jointing part 920 for mounting a charger and rear jointing part 940. Various kinds of components are attached to the frame 901.

The cleaning device 400 is now described in detail as follows:

The cleaning device 400 has a housing (hereinafter referred to as cleaner housing) that is formed by the cleaner portion 401 of the frame 901 of the second process unit 900. A cleaning blade 404 supported by a blade holder 402 is attached to the upper part of the cleaner housing 401 on the side of the light-sensitive drum 300. F-side and R-side ends of the cleaning blade 404 is provided with second sealing member 414. A toner receiving seal 409 supported by a seal plate 407 is secured with screws to a lower part of the cleaner portion 401 on the side of the light-sensitive drum 300.

At the R-side cleaner portion 401, there is a transporting portion 421 having a vacant space 408 to which a toner transporting pipe 422 having an internal cylindrical vacant space is connected. The transporting pipe incorporates a first toner conveyer screw 424 rotatably supported at its both ends by a F-side bearing (not shown) and a R-side bearing 423. A driving gear 425 secured to the R-side rotary shaft end of the screw conveyer 424 engages with a driving gear of the copier housing. The first screw conveyer 424 can thus be rotated from the copier side.

The toner-transporting pipe 422 of the transporting portion 421 has a slide shutter 426 and a spring 427 mounted thereon. In the process of mounting the second process unit 900 into the copier housing 1, the slide shutter 426 abuts on an engaging portion of the copier housing 1 and moves in the direction F to open a discharging port of the toner transporting pipe 422. When the second process unit is drawn back to the front side of the copier housing 1, the slide shutter 426 moves to the direction R and abuts on the bearing 423 to close the discharging port of the toner transporting pipe 422.

The front-side connecting portion 920 and the rear-side connecting portion 940 are provided with a first seal member 428 disposed on the side of the light-sensitive drum 300.

Functions of the cleaning device 400 when it is mounted in the copier housing 1 and operated are as follows:

The cleaning blade 404 in contact with the external cylindrical surface of the light-sensitive drum 300 scrapes off unused toner remaining on the surface of the light-sensitive drum 300 and provides a seal of an opening (cleaner opening) 411 between the cleaning blade 404 and the toner receiving seal 409, thus preventing dispersion of toner particles on the downstream side in the rotation direction of the light-sensitive drum 300.

As shown in FIG. 9, the toner receiving seal 409 being in contact with the external cylindrical surface of the light-sensitive drum 300 seals the upstream side of the drum with respect of the drum rotation direction and guides by its back surface (reverse to the surface abutting the drum) toner particles scrapped by the cleaning blade 404 from the drum surface 300 to the first toner conveyer screw 424.

The second seal member 414 guides toner moving in the longitudinal directions (in the directions F and R) along the cleaning edge 405 of the cleaning blade 404 abutting against the external cylindrical surface of the light-sensitive drum 300 toward the side parting from the drum. The toner moves to the first seal member 428 located in the longitudinal directions of the cleaning blade 404, thus lessening the load of the first seal member 428.

Figure 11C:
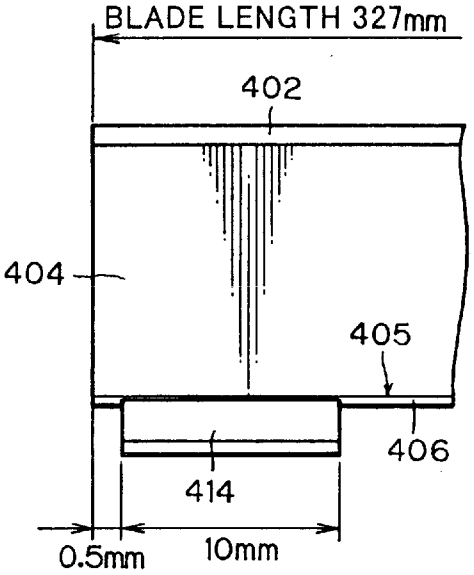
FIGS. 11A to 11C shows a construction for fitting a second seal member.
Figure 11B:
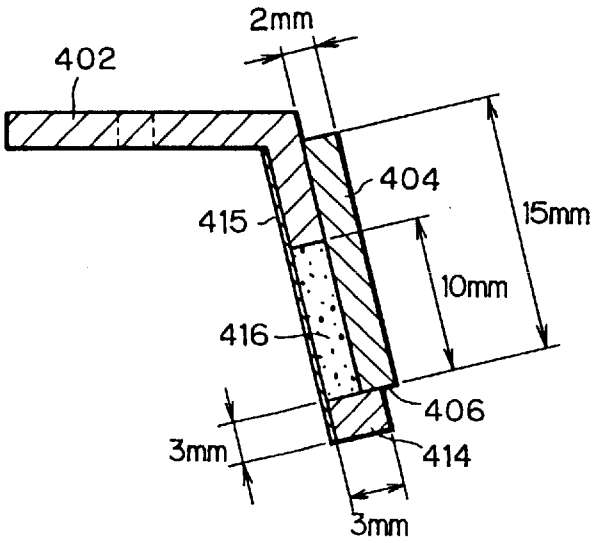
Figure 11A:
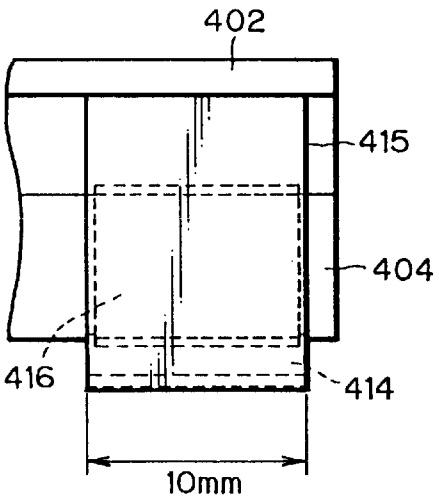

FIGS. 11A to 11C illustrate how to fit the second seal member 414. FIG. 11A shows the rear side of the cleaning blade 404 to which a film 415 is bonded. FIG. 11B is a sectional view of the cleaning blade 404 and FIG. 11C is a front view of the cleaning blade 404. As shown in FIG. 11, the second seal member 414 is bonded to an end of the flexible film (flexible seal) 415 that in turn is bonded at the other end to the blade holder 402 in such away that the second seal member 414 keeps a constant distance from the blade holder 402 and is in contact with the end face (cleaning end face) 406 of the cleaning blade 404. An elastic foam body 416 is also bonded to the film 415 to be disposed between the film 415 and the cleaning blade 404. The film 415 has elasticity and can elastically bend in the direction parting from the external cylindrical surface of the light-sensitive drum 300.

The second seal member 414 having the above construction can be adjusted for its position relative to the cleaning blade 404 since the film body 415 is pushed through the elastic foam body 416 (spacer) disposed between the cleaning blade 404 and the film body 415 in accord with the abutting state of the cleaning blade 404 on the light-sensitive drum 300. With the film body 415 possessing higher elasticity for pressing the cleaning edge 405 of the cleaning blade 404, the second seal member does not strongly press the surface of the light-sensitive drum 300. In practice, when the cleaning blade 404 is elastically bent contacting its edge 405 with the external cylindrical surface of the light sensitive drum 300, the elastic foam body 416 is correspondingly compressed and causes, by the effect of its restoring force, the film body 415 to be elastically bent. The second seal member 414 can be thus kept in a constant position relative to the cleaning edge 405. This eliminates the possibility of reversing the cleaning blade 404 being strongly pushed at its cleaning end 406 by the second seal member 414.

The second seal member 414 is made of urethane elastic foam (porous material) and completely fills a gap 419 between the cleaning end-face 406 and the external cylindrical surface of the light-sensitive drum 300 to effectively separate toner from the light-sensitive drum 300.

The elastic foam body 416 is a continuous foam sponge made of ether polyurethane foam, which is softer than closed cell body and may cause the film body 415 to be smoothly bent along the curve of the cleaning blade 404 when it changes according to the bend of the cleaning blade 404. Therefore, the position of the second seal member is not largely changed.

If the elastic foam body 416 presses the end of the cleaning blade 404 toward the reverse direction, its contact pressure to the cleaning blade 404 is equalized over the wide contact surface between them. Therefore, the cleaning blade 404 can be smoothly (not partly) deformed without impairing its cleaning performance. There is no fear of reversing the blade 404. The elastic foam body 416 is a suitable seal member that may not strongly press the film body 415.

The second seal member 414 is desirable to have, at least, a foam (porous) surface opposite to the cleaning blade 404 and the light-sensitive drum 300. Preferably, it is made of elastic foam body. When the second seal member 414 contacts at its porous surface with the cleaning blade 404 and the light-sensitive drum 300, it can smoothly slide with no fear of causing vibration that may affect the contact of the cleaning blade 404 with the external cylindrical surface of the light-sensitive drum 300. This also eliminates the possibility of reversing the cleaning blade 404 due to increasing the contact pressure to its longitudinal end. The second seal member 414 made of elastic foam material can reliably adhere at its skin layer to the film body 415. Urethane foam is best suited to use as the second seal member 414 since it may not chemically affect the light-sensitive layer of the external cylindrical surface of the light-sensitive drum 300, thus maintaining the quality of images to be formed thereon for a long period.

FIGS. 11A to 11C shows exemplary dimensions of the cleaning blade 404, film 415, elastic foam body 416, second seal member 414 and blade holder 402.

The film body 415 is made of flexible material such as PET (Polyethylene terephthalate). The film is of 188 $\mu$m in thickness and has a size of 10 mm×15 mm.

The cleaning blade 404 is 2 mm thick and 15 mm wide (in the direction perpendicular to its longitudinal direction). The blade is attached at its width by 5 mm to the blade holder 402. The elastic foam (spacer) 416 is of 2.6 mm in thickness in its stress-free state and can fill a space formed by the thickness (1.6 mm) of the blade holder 402. It is made of continuous foam material such as ether polyurethane foam.

The second seal member 414 has a width of 10 mm and has a square section of 3 mm×3 mm (3 mm in the direction from the film 415 to the blade edge 405 and of 3 mm in the direction of its thickness).

As shown in FIG. 11C, both sides of the second seal member 414 are short by a given size (0.5 mm in the shown case) from the respective sides of the cleaning blade 404. This enables the second seal member 414 to be disposed in a specified position relative to the cleaning edge 405 of the cleaning blade 404 without interference with the first seal member disposed by the side of the cleaning blade 404.

The cleaning blade 404, second seal member 414, film body 415, elastic foam body 416 and blade holder 402 form a unit block that can be easily mounted into the cleaner housing 401 or demounted therefrom. It is not required for one to remove only the second seal member 414 by fingers from the cleaning device 400. This eliminates the possibility of damaging the toner receiving seal 409 and soiling hands when replacing the second seal member with new one. The number of working steps is also saved. In addition, the cleaning device 400 can be further reduced in its size by reducing a gap between the first toner screw-conveyer 424 and the cleaning blade 404.

The first seal member 428 is pressed to a non-image area of the external cylindrical surface of the light-sensitive drum 300 to prevent toner from leaking out of the cleaning device 400 through a cleaner opening 411 and the longitudinal end of the cleaning blade 404.

The electrically charging device 500 is now described as follows:

As shown in FIG. 3, the electrically charging device 500 can be mounted/removed in/from a charger mounting portion (front connection 920 and rear connection 940 arranged above the a drum holder front part 902 and a drum holder rear part 907) of a frame 901 of the second process unit 900. The electrically charging device 500 is at first inserted into an opening 922 made in a front vertical mounting part 921 of the front connection 920 and connected at its concave guide 509 with the front vertical mounting part 921 and a rear vertical mounting part 941 of the a front connection (charger mounting portion) 920 by fitting therein convex guides 911 and 912 extending in the directions F and R respectively. The charging device 500 is further inserted along the convex guides 911, 912 until two (upper and lower) convex locators 532 and 533 integrally formed with a rear holder 531 are inserted into openings 932 and 933, respectively, of the rear vertical mounting part 941 of the frame 901 (as shown in FIG. 3). In this state, an elastically bendable and movable engaging part 522 of the electrically charging device 500 engages with an engaging part 923 of the front vertical mounting portion 921 as shown in FIG. 4. The electrically charging device 500 is now fixed in the given position. To demount the electrically charging device 500, the movable engaging part 522 is pressed downward (in FIG. 4) to disengage it from the engaging part 923 and is then drawn out in the direction F along the convex guides 911 and 912.

When the second process unit 900 with the electrically charging device 500 has been mounted in the copier housing 1, electrodes (screws) 534 and 535 in the convex locators 532 and 533 are brought into contact with electrodes disposed on the copier housing to cause a grid 550 to conduct and have a given potential. The electrically charging device 500 can also be removed separately after mounting the second process unit 900 in the copier housing.

Figure 12:
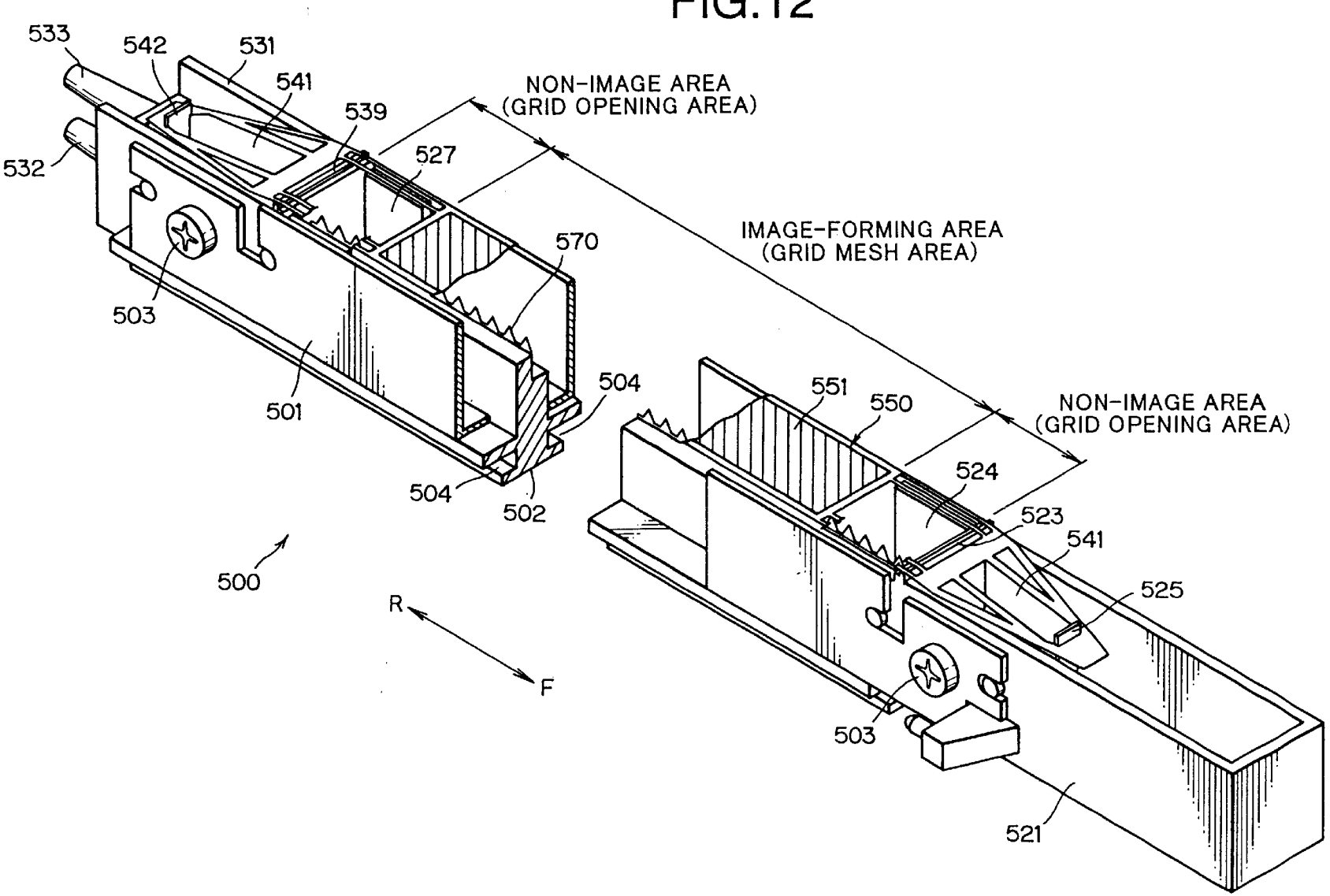
FIG. 12 is a perspective illustration of an electrically charging device viewed from its grid side.

As shown in FIGS. 4 and 12, the electrically charging device 500 is secured at front and rear holders 521, 531 with fixing screws 502 to a well-conducting metal-made case 501 holding a discharging electrode holder 502. The grid 550 is restricted in height from a corona discharge electrode 570 (to be described later) by height-limiting protrusion 523 of a front holder 521 and height-limiting protrusion 539 of a rear holder 531. In this state, a stretch-mounted electrode 525 secured to the front holder 521 engages in a front engaging opening 524 of the grid 550 and a stretch regulating electrode 528 (FIG.4) disposed on the rear holder 531 engages in a rear engaging opening 527 of the grid 550.

The screw-electrode 535 has a threaded neck screwed 537 in a threaded hole made in the rear holder 531 and in a threaded hole made in the stretch-mounted regulating electrode 528. Rotation of the screw-electrode 535 causes the stretch regulating electrode 528 to move together with the grid 550 engaged therewith. The grid 550 can be thus stretched, eliminating the possibility of sagging of the grid 550 at uneven levels in its longitudinal directions with respect to the corona discharge electrode 570. The head of the screw-electrode 535 is in contact with an electrode of the copier housing.

The case 501 is electrically connected to stretched electrode 525 through an intermediate conductor 526, by which it has the same potential as the grid 550 has.

The corona-discharge electrode 570 is bonded to a corona-discharge electrode holder 502. It is in contact with the intermediate conductor 571 which the threaded portion of the screw-electrode 534 projecting from the rear holder 531 is screwed. Thus, the corona electrode 570 is powered from the copier body through the screw-electrode 534 and discharges corona from its tip 571.

As shown in FIGS. 4 and 12, the corona discharge electrode 570 is disposed opposite with its full length to the light-sensitive drum 300 in the longitudinal direction of the charging device 500. A mesh area 551 of the grid 550 is opposite to an image-forming area (light-sensitive surface area) of the external cylindrical surface of the light-sensitive drum 300. The grid 550 directs its openings 524 and 527 to a non-imaging area of the external cylindrical surface of the light-sensitive drum 300. When the corona-discharge electrode 570 discharges toward the external cylindrical surface of the light-sensitive drum 300, the mesh area 551 of the grid 550 with a specified potential controls a charge over the image-forming area of the drum 300 to an even and specified potential level. A charge discharged from the corona-discharge electrode 570 through the openings 524 and 527 of the grid 550 is given to the non-imaging area of the external cylindrical surface of the light-sensitive drum 300, producing a specified potential thereon. The discharge electrode holder 502, the front holder 521 and the rear holder 531 are made of material PS-HI+PPE having high electrical insulation. The saw-toothed corona-discharge electrode 570, the grid 550 and the case 501 are made of stainless steel.

Figure 13:
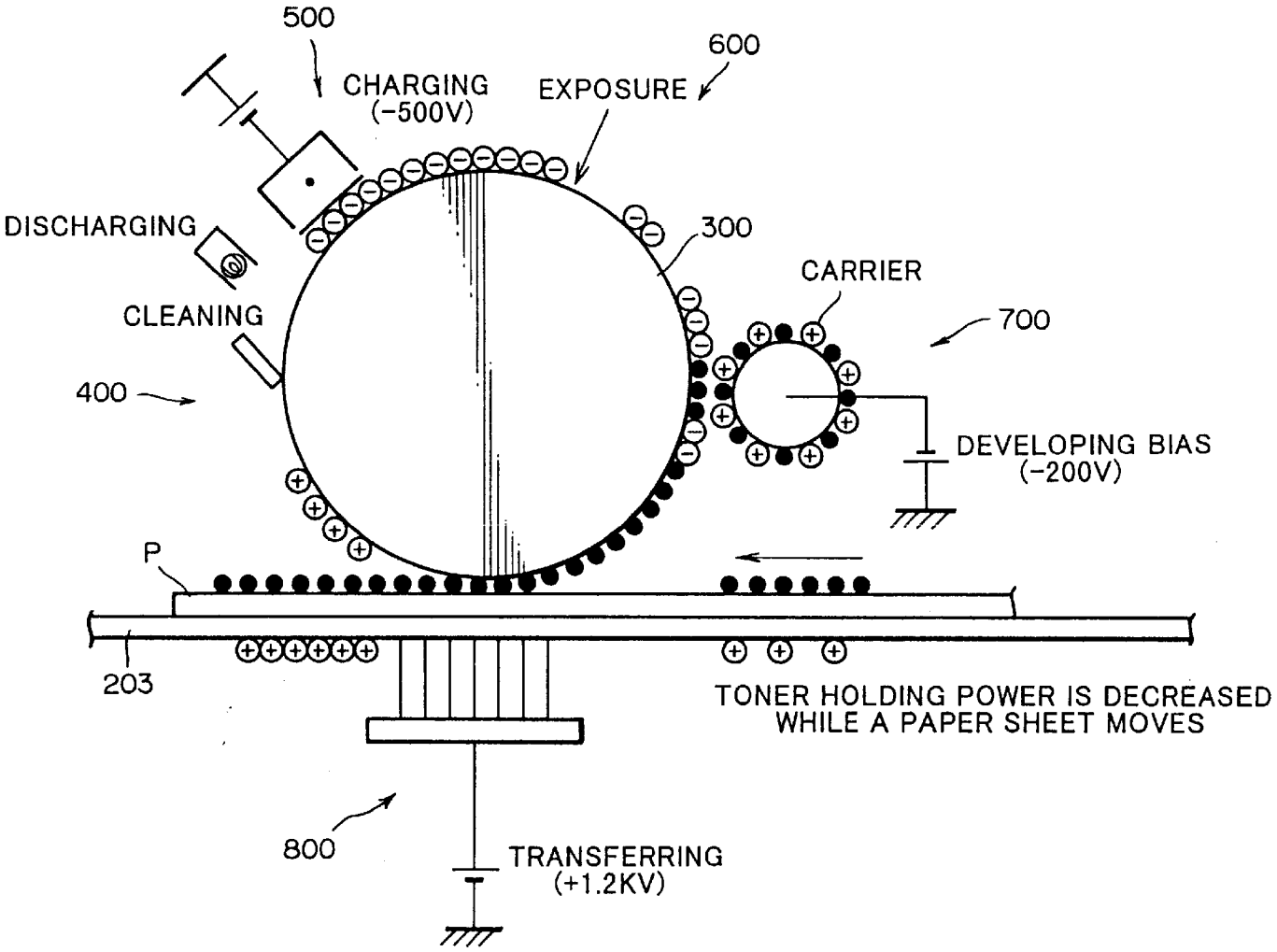
FIG. 13 is a mimic diagram for explaining a process of forming an image at each image-forming station.
Figure 14:
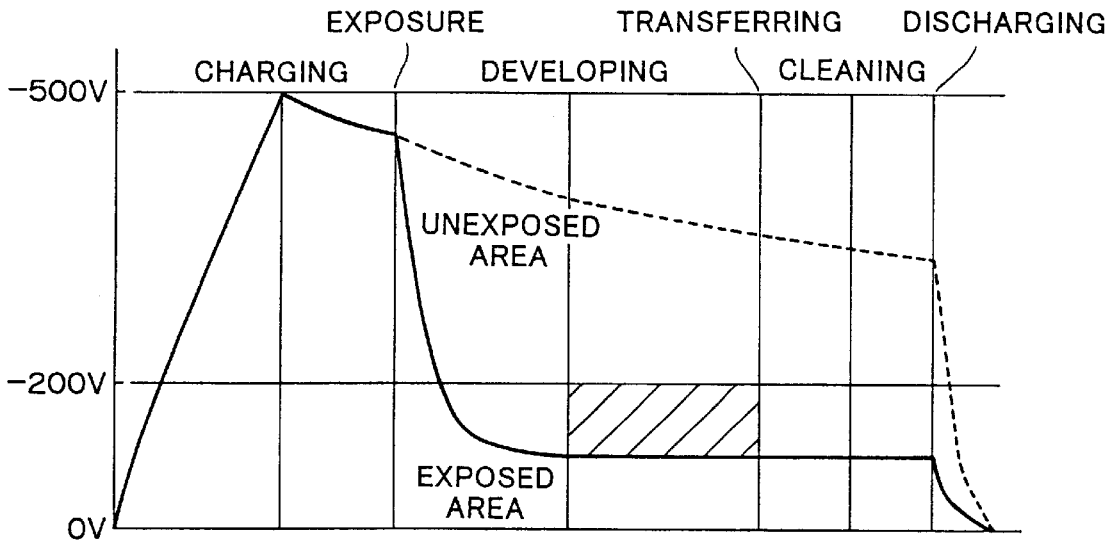
FIG. 14 shows state-transition diagram of a surface potential of a light-sensitive drum in image-forming steps illustrated in FIG. 13.

The image-forming process to be performed in the image-forming station Pd, which is representative of the stations Pa–pd having the same structure, will be described briefly (with suffix "d" omitted). FIG. 13 illustrates how to form an image on a light-sensitive drum by devices disposed around the drum 300. FIG. 14 shows how the potentials on the surface of the light-sensitive drum 300 change during the image-forming steps.

Figure 15:
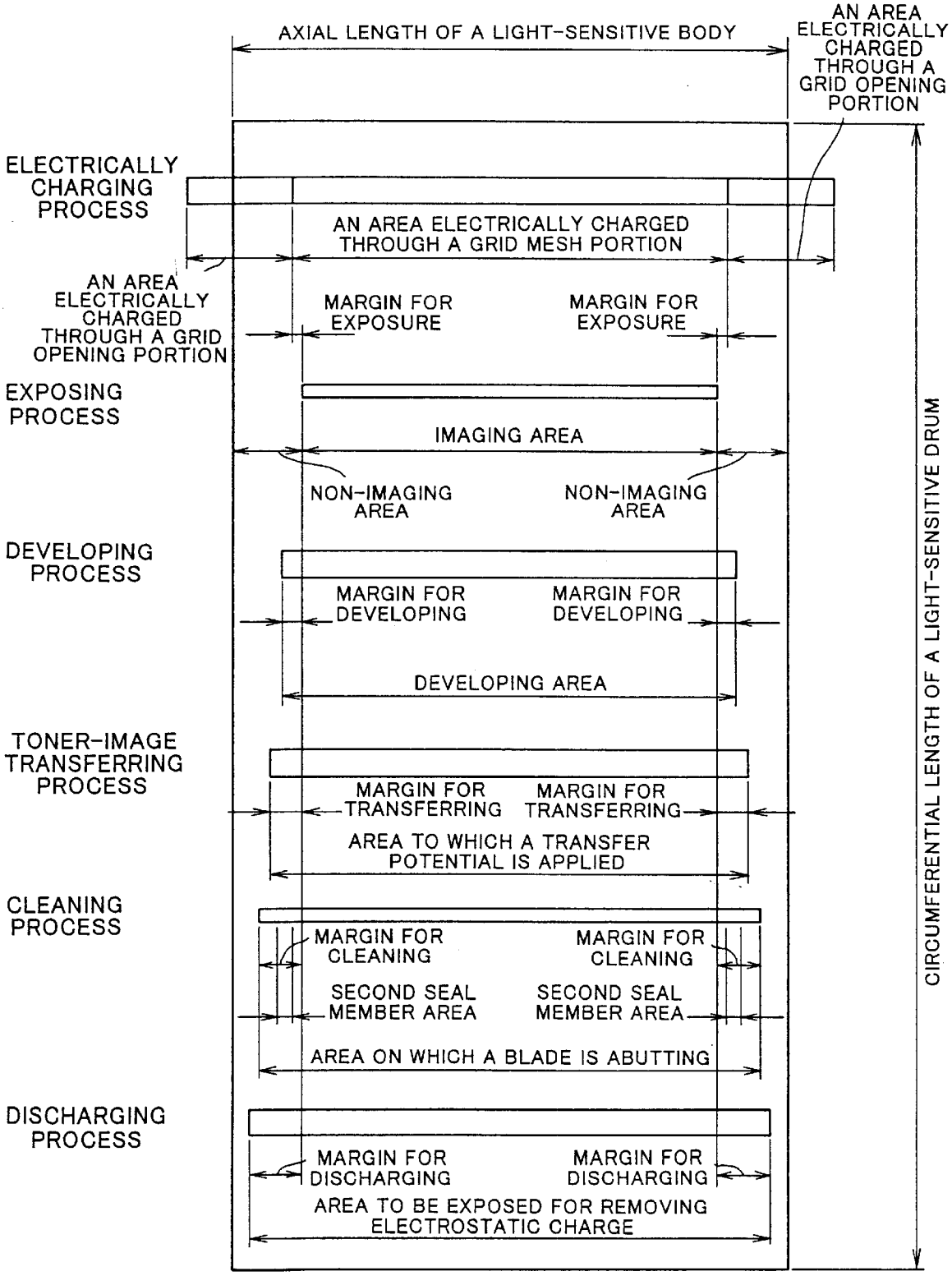
FIG. 15 is a view for explaining a relationship between surface regions of a light-sensitive drum and the image-forming steps of FIG. 13.

As shown in FIGS. 13 to 15, the external cylindrical surface of the light-sensitive drum 300 is evenly charged with a specified negative potential (−500V) by the electrically charging device 500 in an electrically charging step. An axial length of the light-sensitive body to be electrically charged by the grid 550 (hereinafter called "charged width") is a total of an axial length of the electrically charged area of the light-sensitive drum, which is opposite to the mesh area 551 (hereinafter called "mesh charged width"), and an axial length of another electrically charged area, which is opposite to the openings 524 and 527 (hereinafter called "opening charged width").

In the next exposure step, the external cylindrical surface of the light-sensitive drum 300 is scanned with laser beam by the laser beam scanner unit (LSU) 600 according to image data to form a latent image on the image-forming area thereof. The potential on the scanned-exposed area (to be developed with toner in a next developing step) absurdly drops to a negative potential of a small absolute value (about −100V) to be developed by the next step. On the other hand, a potential on the unexposed area (not to be developed with toner in the next developing step and an axial length of non-imaging area of the light-sensitive drum (hereinafter called "non-imaging width") remains at a negative potential of a large absolute value (about −250V) with black attenuation. The mesh charged width is longer than the length of the image-forming area in the axial direction of the light-sensitive body (hereinafter called "image width"), i.e., it can include the image width. This is meant for forming a latent image within an evenly charged area on the light sensitive drum by giving margins for exposure (shown in FIG. 15) to the image width since the both end areas of the light-sensitive drum in its axial direction may be charged unevenly by the mesh area 551. The non-imaging area of the external cylindrical surface of the sensitive drum 300 is similarly charged.

In the developing step, the developing device 700 develops with toner the latent image formed on the drum by the exposure step. In this Step, the latent image formed with a negative potential on an image area of the light-sensitive drum 300 is developed at a negative developing potential with toner electrically charged with the same polarity (negative) potential. Therefore, toner is supplied only to parts (elements) having a potential whose absolute value is smaller than the developing potential (−200V). On the other hand, toner cannot be supplied to parts (elements) having a potential whose absolute value is larger than the developing potential (−200V). Consequently, toner is transferred only to parts exposed to a laser beam from the laser beam scanner (LSU) 600, thus producing a toner image. At the same time, toner is supplied to a part of non-imaging area but does not adhere thereto because the non-imaging area has a negative potential whose absolute value is larger than the developing potential. In the developing step, a specified margin ("developing margin" in FIG. 15) is provided for the image area since both end parts in the axial direction of the light-sensitive body may not evenly be developed with toner.

In the image-transfer step, a transfer discharger 800 disposed on the reverse side of the transfer belt gives a paper sheet P held on the transfer belt 203 a potential (+1.2V) whose polarity is reverse to that of toner and whose absolute value is larger than that of the image area surface potential. The toner image formed on the external cylindrical surface of the light-sensitive drum 300 can thus be transferred from there onto the paper sheet P by the effect of the electrostatic force.

A specified margin (transfer margin in FIG. 15) is also given to both ends of the image area since potentials on the both ends of the transfer means in the axial directions of the light-sensitive body may be less than the center portion of the image area.

In the cleaning step, the external cylindrical surface of the light-sensitive drum 300 is cleaned by the cleaning device 400 from toner not transferred to the paper sheet P in the preceding step or returned from there. In this step, cleaning is conducted with a specified margin for the image width (cleaning margin in FIG. 15). The second seal member 414 as described before is disposed outside the image area.

In the last "discharge" step, the external cylindrical surface of the light-sensitive drum 300 including a specified margin of the image area (discharging margin in FIG. 15) is discharged to substantially "zero" potential thereon. This is essential for achieving even potential (exposure) on the image area of the light-sensitive drum in the proceeding charging step.

Margins used for the above-described steps are set larger in the order of exposure margin, developing margin, transferring margin, cleaning margin and discharging margin as shown in FIG. 15.

Figure 16:
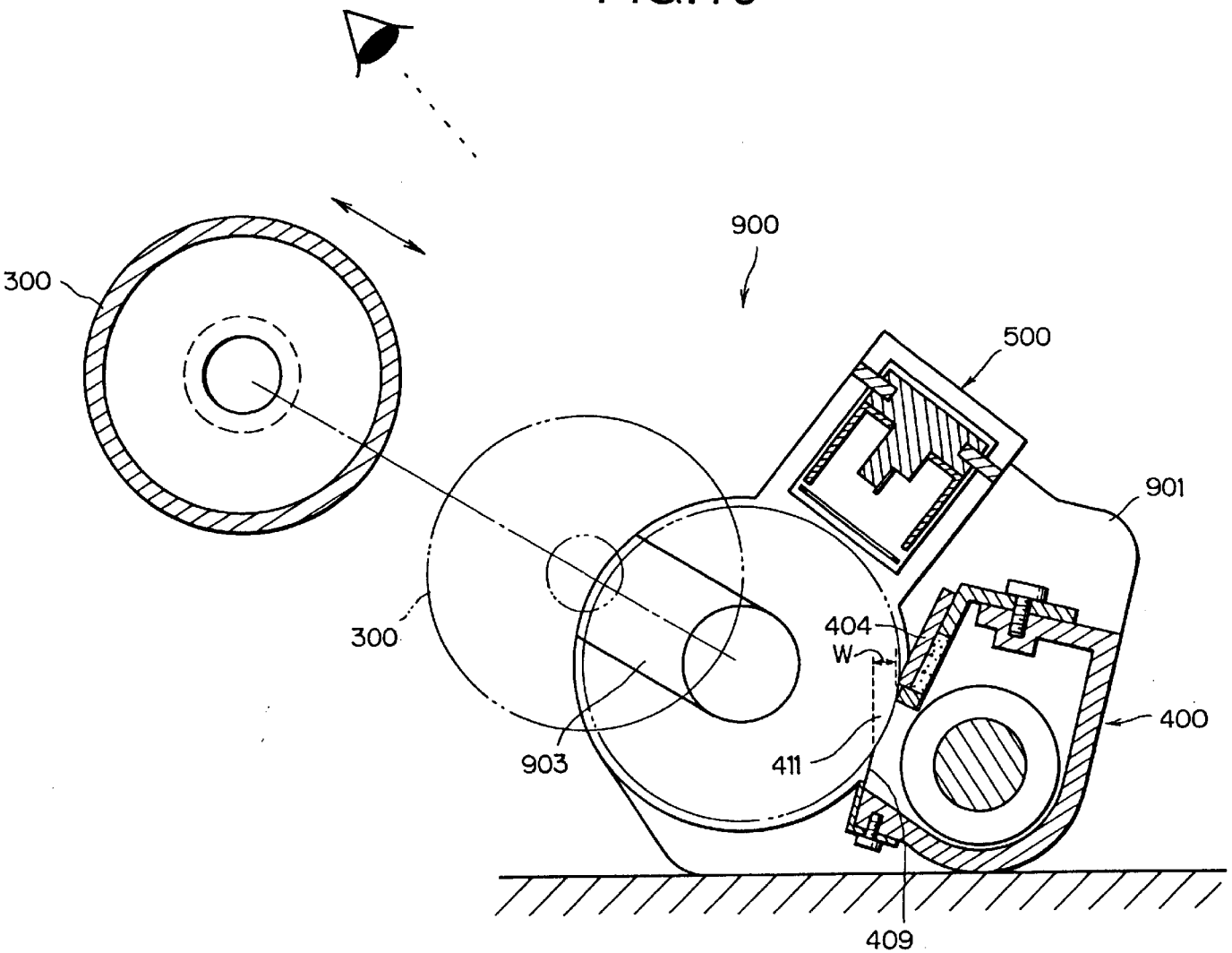
FIG. 16 a sectional view for explaining how to mount/remove a light-sensitive drum with a light-sensitive unit placed on a working surface.
Figure 17A:
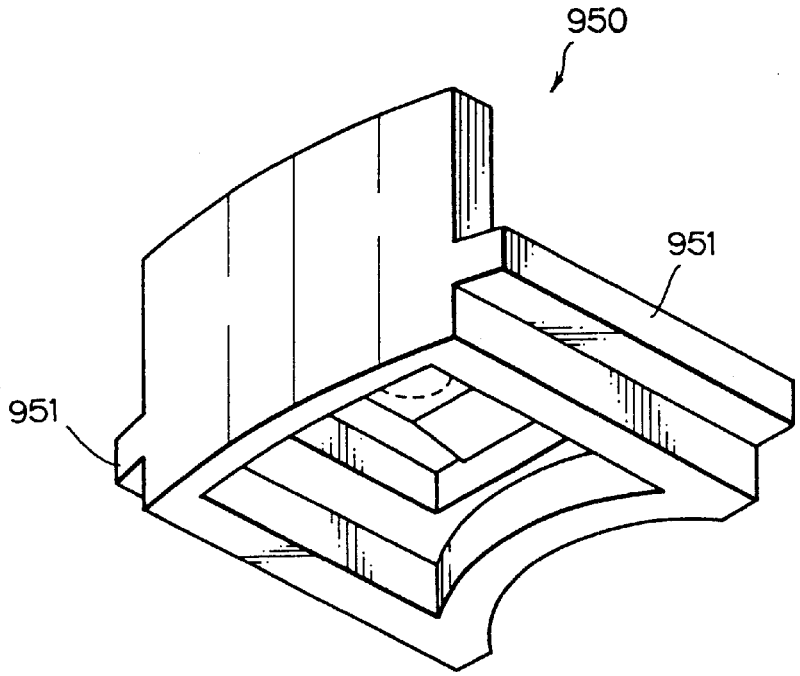
FIGS. 17A and 17B shows a perspective illustration and a top view of a stopper for fixing a light-sensitive drum to a light-sensitive unit.
Figure 17B:
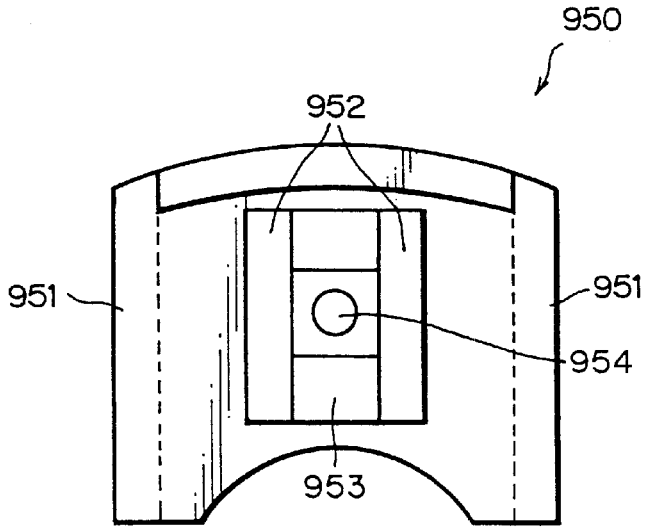

Referring now to FIGS. 3–5, 16 and 17, a method of mounting/demounting a light-sensitive drum 300 in/from a second process unit 900. FIG. 16 is a sectional view of the second process unit placed on a flat surface of a working table. FIG. 17 shows a stopper 950 for preventing the light-sensitive drum 300 from slipping of f from a frame 901 of the second process unit 900.

As shown in FIGS. 3 and 16, the light-sensitive body unit 900 has an electrically charging device 500 integrally mounted thereon.

Mounting of the light-sensitive drum 300 on the frame 901 of the second process unit 900 is carried out as follows:

A rear shaft part 303 of the light-sensitive drum 300 is inserted into a through hole 908 made in a rear-side drum holder 907 (Steps (① and ② in FIG. 3) and a front shaft part 301 of the light-sensitive drum 300 is horizontally turned relative to the rear shaft part 303 inserted in the through hole 908 until it is inserted through a mounting/demounting guide groove 903 into a front-side drum holder 902 of the second process unit 900 (Step ③ in FIG.3). The stopper 950 is then inserted the front-side drum holder 902. The mounting of the light-sensitive drum 300 in the second process unit 900 is now completed. The stopper 950 has a protrusion 951 that engages in a recess 904 made in the wall of the guide groove 903 of the front-side drum holder 902. The stopper 950 is thus located therein and does not slip off from the front-side drum holder 902 even if it is subjected to vibration.

As shown in FIG. 17, the stopper 950 has the protrusion 951 and two slits 952 separated by an elastically deformable part 953 with a semispherical convex 954 formed at center position thereof. On the other hand, the guide groove 903 of the front side drum holder 902 has a semispherical concave 906 formed on its wall (as shown in FIG. 3). When the stopper 950 is inserted into the groove 903 of the front-side drum holder 902, the stopper 950 is elastically deformed and engages its semispherical convex 954 in the semispherical concave 906 of the guide groove 903. The stopper 950 now restores its initial state in the elastically deformable part 953, thus being locked in the front-side drum holder by.

Demounting the light-sensitive drum 300 from the second process unit 900 is carried out in the following manner:

First, catch the stopper 950 by its back by fingers inserted through a notch 905 formed in the side-wall of the front-side drum holder 902 and draw it therefrom. Then, the light-sensitive drum 300 is removed from the second process unit by performing the above steps in the reverse order.

Referring to FIG. 5, a method of holding the light-sensitive drum 300 by hands is described bellow.

Figure 5A:
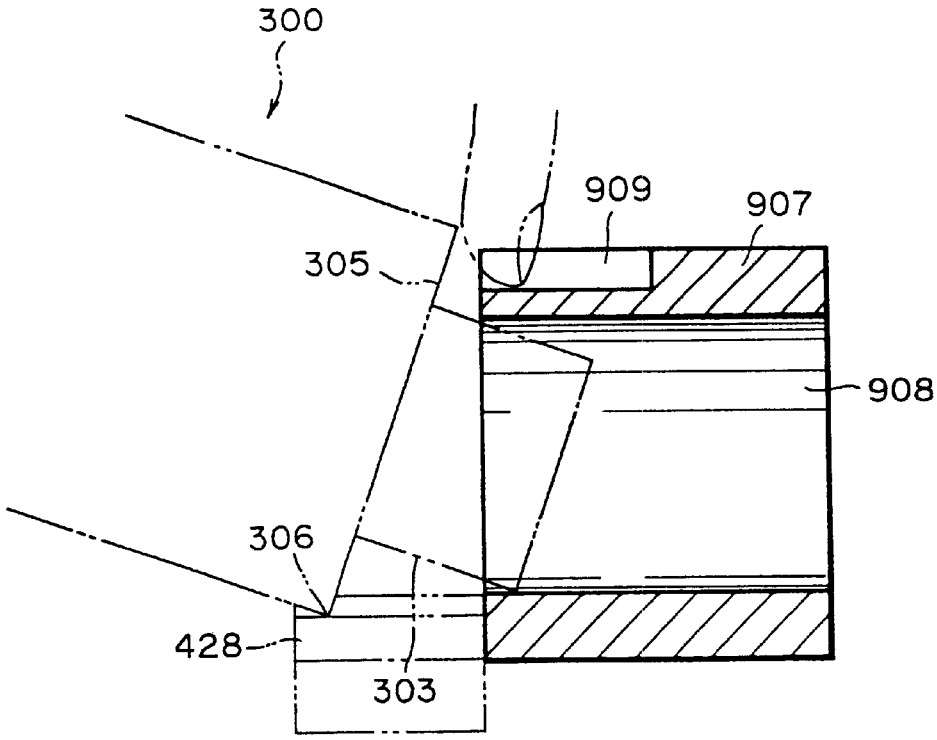
FIGS. 5A to 5B are views for explaining how to mount a light-sensitive drum in a frame of the light-sensitive unit.

As shown in FIG. 5A, pick up both end faces 305, 305 of the light-sensitive drum 300 by fingers of respective hands and insert its rear shaft 303 into the through hole 908 made in the rear-side drum holder 907 (Steps ① and ② as described above). At this time, a recess 909 formed in the rear-side drum holder 907 enables the user to insert the rear shaft 303 of the drum 300 in the through hole 908 with no interference with his or her fingers holding its rear-end face 305. Next, mount the front shaft 301 of the light-sensitive drum 300 in the front-side drum holder 902 along the guide groove 903 (Step ③). At this time, the user can also hold the front-end face 305 of the drum 300 since an open space formed in the side wall in the front-side drum holder 902 for mounting the stopper 950 gives refuge to the fingers as the recess 909 in the rear-side drum holder 907 does. When demounting the light-sensitive drum from the front-side and rear-side drum-holders 902 and 907, the user can easily catch by his or her fingers the both end-faces 305 of the drum, utilizing the above recesses.

Figure 5B:
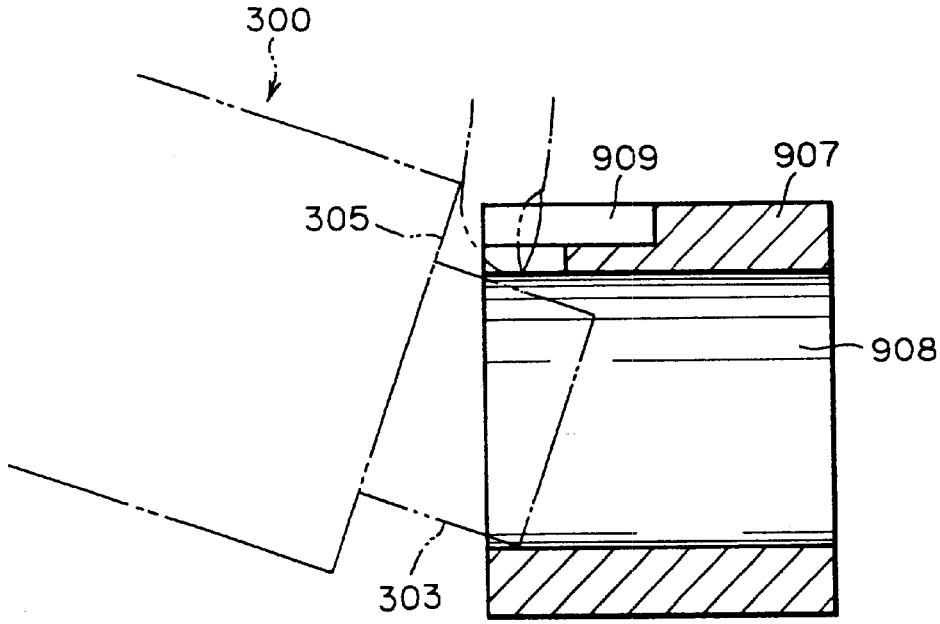

The recess 909 may be omitted if the rear shaft 303 of the light-sensitive drum 300 is so long and the through hole 908 of the rear-side drum holder 907 is so large that the shaft 303 (bearing portion) may be inserted into the hole 908 at an angle. However, in case if the rear-side drum holder 907 also accommodates in its through hole 908 a locating block 152 from the copier housing 1 (to be described later with reference to FIG. 20) together with the elongated shaft 303, the light-sensitive drum 300 is elongated in the rear-side axial direction, resulting in elongation of the second process unit 900 in the same direction. The recesses may be formed in the shape of a notch as shown in FIG. 5B.

Figure 6:
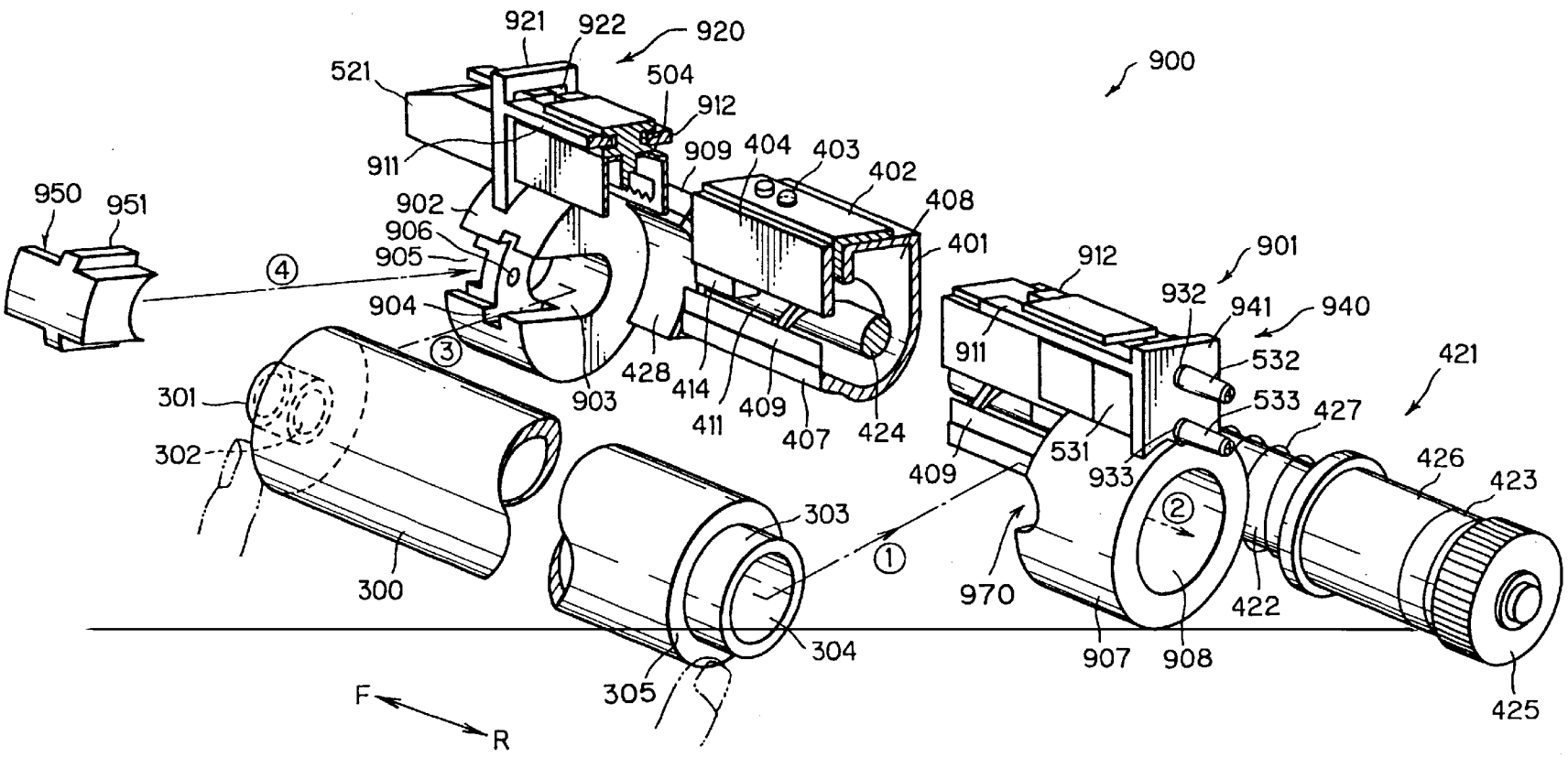
FIG. 6 is a perspective illustration of another light-sensitive unit having a different construction of a rear portion of a drum holder from the rear side of the unit.
Figure 7:
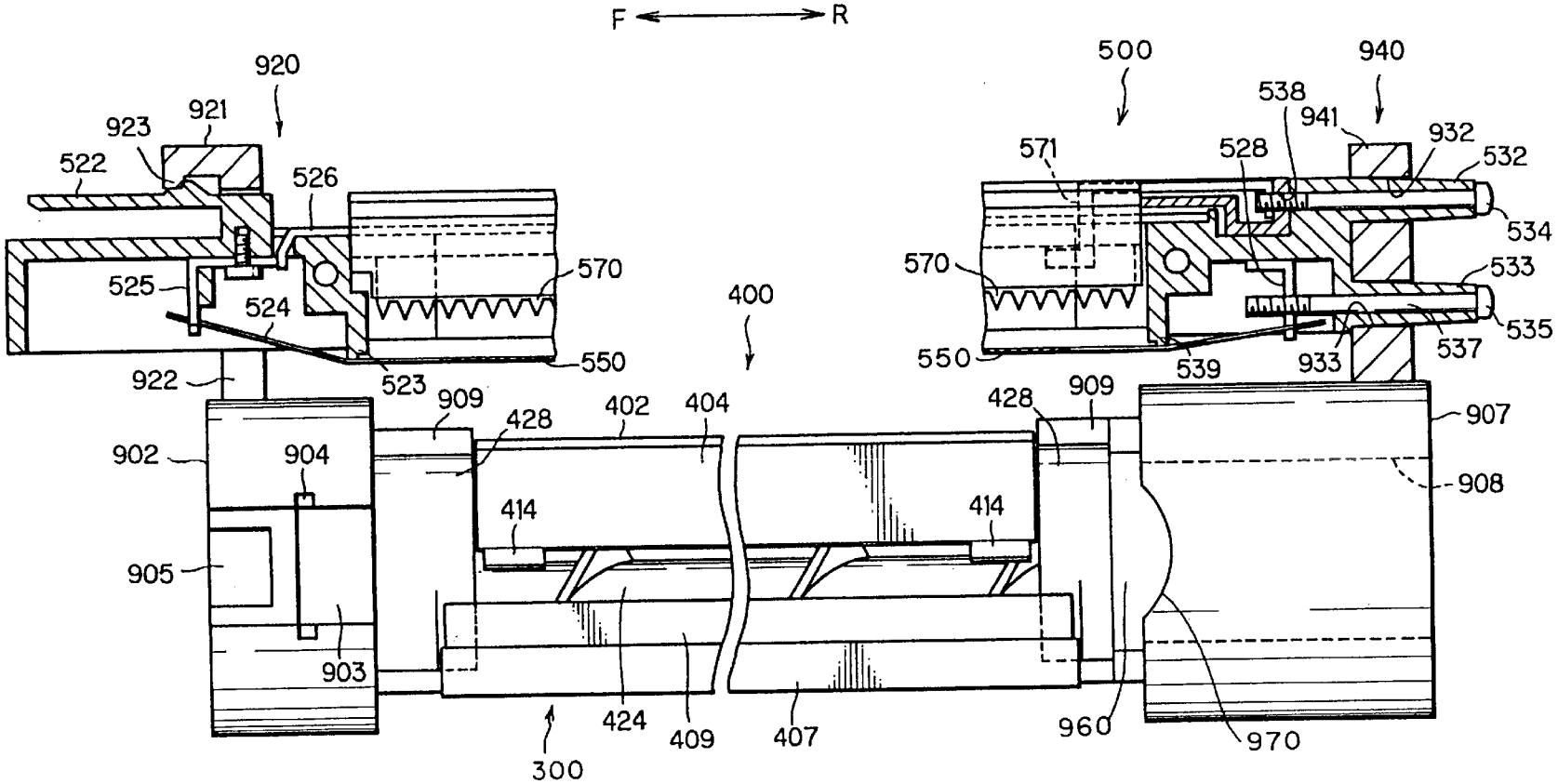
FIG. 7 is a sectional illustration of an essential section of another light-sensitive unit, viewed from the side of a light-sensitive drum (not shown).

Referring now to FIGS. 6 to 8, another exemplary structure of the light-sensitive drum 300 and a method of mounting/demounting the light-sensitive drum 300 in/from the second process unit, which is different from and alternative to those described above with reference to FIGS. 3 to 5, will be described below.

FIG. 6 is illustrative of a structure of a light-sensitive drum 300, which is similar to but differs from that of FIG. 3 by its rear-side drum holder 907. FIG. 7 is a front elevational view, partly in cross section, of a second process unit 900 with a light sensitive drum 300 removed, which is viewed from the side of the light-sensitive drum 300.

As shown in FIG. 6, the light-sensitive body unit 900 (the second process unit) has an electrically charging device 500 mounted therein.

As shown in FIGS. 6 and 7, the second process unit has a structure for mounting/demounting a light-sensitive drum according to the modified embodiment, wherein a front-side drum holder 902 and a rear-side drum holder 907 are disposed opposite to each other and support respective ends of a light-sensitive drum 300 disposed between them. The rear-side drum holder 907 has a through hole 908 formed therein for insertion of the rear supporting shaft (end shaft) 303 made on the rear side of the drum 300.

The front-side drum holder 902 has a stopper 950 removably mounted thereon and has a guide groove 903 by which the front supporting shaft 301 of the light-sensitive drum 300 is mounted in the holder before fitting the stopper 950 for preventing the shaft of the drum from slipping off from the front-side drum holder 902.

On the other hand, the rear-side drum holder 907 has a bearing portion 960 formed as an axially stepped extension of the inner wall of the holder 907 (FIG. 7).

A notch 970 is formed in the stepped portion of the holder 907. The bearing portion 960 serves as a regulating means for restricting the movement of the rear-side supporting shaft 303 of the light-sensitive drum 300 to prevent the external cylindrical surface of the drum 300 from contacting with surrounding members when mounting the drum in the rear-side drum holder 907.

A method of holding the light-sensitive drum when mounting it in the drum holders is described below. In the shown case, one end of the supporting shaft of the light-sensitive drum 300 is mounted inserted into the through hole 908 made in the rear-side drum holder 907.

Figure 8A:
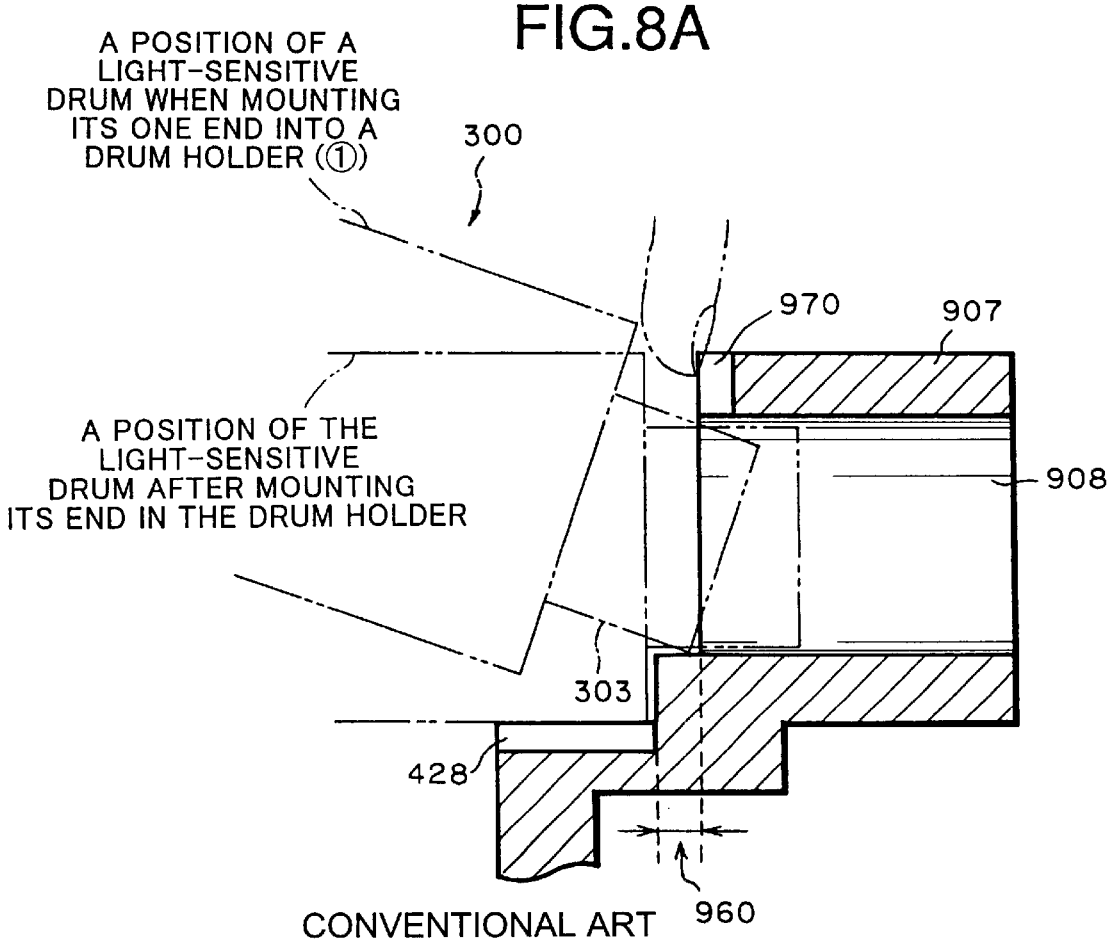
FIGS. 8A and 8B are views for explaining how to mount a light-sensitive drum in a frame of another light-sensitive unit.

In practice, the user catches by both hand (fingers) the light-sensitive drum 300 by both end-faces and inserts the rear supporting shaft 303 of the drum 300 into the through hole 908 of the rear-side drum holder 907 (corresponding to Steps ① and ② in FIG. 6). In this instance, the bearing portion (regulating means) 960 of the rear-side drum holder 907 restricts the movement of the rear supporting shaft 303 of the drum 300 not to slip out from the through hole 908 (FIG. 8A). Furthermore, the notch 970 made in the stepped portion of the rear-side drum holder 907, which is opposing to the bearing portion 960, gives refuge to the user's fingers holding the rear-side of the light-sensitive drum 300, thus enabling the user to insert the rear supporting shaft 303 into the through hole 908 with no interference with fingers.

Figure 8B:
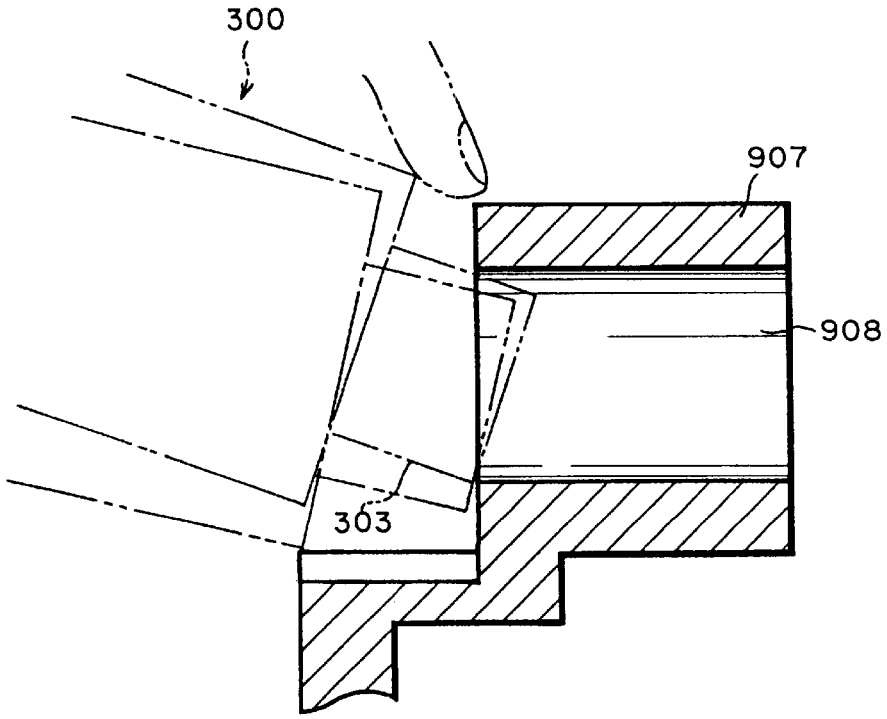
CONVENTIONAL ART FIG.8B

FIG. 8B shows a case of the conventional devices wherein the rear-side drum holder has not a bearing portion 960 (regulating means) and, therefore, makes it difficult to insert the rear shaft 303 of the drum 300 into the through hole 908 at the corner of existing in the direction drum 300 is inserted in the hole 908. Consequently, the rear shaft 303 can excessively move out of the through hole 908, causing damaging by its edges a cleaning blade 404 of a cleaning device 400, toner receiving seals 409 and other members disposed around the rear-side drum holder 907 and damaging its light-sensitive surface by the edges of the rear-side drum holder.

The above problem is solved by the present invention by providing the bearing portion 960 that can restrict the movement of the rear-supporting shaft 303 of the light-sensitive drum 300.

The front supporting shaft 301 of the light-sensitive drum 300 is then mounted in the front-side drum holder 902 by horizontally turning the shaft and mounting it into the front-side drum holder 902 along a guide groove 903 (corresponding to Step ③ in FIG. 6). In this time, the user can easily mount the front supporting shaft 301 in the front-side drum holder 902 with no interference with his or her drum-holding fingers since a open space formed in the side-wall of the front-side drum holder 902 for mounting the stopper 950 therein also gives refuge to the fingers as the notched part 970 in the rear-side drum holder 907 does. The stopper 950 is then fitted in the open space of the front-side drum holder 902 (corresponding to Step ④ in FIG. 6). Thus, the mounting of the light-sensitive drum 300 in the second process unit 900 is completed.

The notch 970 may be omitted if the rear shaft 303 of the light-sensitive drum 300 is so long and the through hole 908 of the rear-side drum holder 907 is so large that the shaft (bearing portion) may be inserted into the hole 908 at an angle thereto. However, in case if the rear-side drum holder 907 also accommodates in its through hole 908 a locating block 152 from the copier housing 1 (to be described later) together with the elongated shaft 303, the light-sensitive drum 300 is elongated in the rear-side axial direction, resulting in elongation of the second process unit 900 in the same direction.

Demounting the light-sensitive drum 300 from the second process unit 900 is carried out in the following manner:

First, the stopper 950 is drawn out from the front-side drum holder 902 by catching the back of the stopper 950 by fingers inserted through a notch made in the front-side drum holder 902. Then, the light-sensitive drum 300 is removed from the second process unit by reversing the operations described above for mounting the drum. The light-sensitive drum 300 can be easily caught by its both end faces by the fingers of respective hands using the above-described recesses provided in the both drum holders.

Referring to FIG. 3, a method of mounting/demounting the light-sensitive drum 300 in/from the second process unit 900 is described below.

As shown in FIG.16, the second process unit 900 is placed on a flat surface of a working table in such a way that the guide groove 903 is directed upwards at a certain angle to the flat surface. This enables the user do the mounting/demounting work, easily looking down at the second process unit 900.

In this instance, since the light-sensitive drum 300 must be mounted/demounted in/from the second process unit 900 without removing the electrically charging device 500, it is essential not to damage the external cylindrical surface of the light-sensitive drum 300 by contacting it with any other elements and devices during mounting/demounting of the drum. A care must be taken not to damage a cleaning edge 405 of the cleaning blade 404 by hitting it with the drum 300. The working steps are as follows:

In Steps ① and ② (FIG. 3), the light-sensitive drum 300 is in contact at its edge 306 with a first seal member 428 as shown in FIG. 5A. Therefore, the external cylindrical surface of the light-sensitive drum 300 cannot contact with the cleaning blade edge 405. In Steps ① and ②, the rear shaft (bearing portion) 303 of the light-sensitive drum 300 is inserted into a through hole 908 made in the rear-side drum-holder 907, whereby a distance between the electrically charging device 500 and the external cylindrical surface of the light-sensitive drum 300 is regulated by an insertion length of the rear shaft 303 of the drum 300 in the through hole 908. Therefore, the drum 300 may not be suffered to damaging of its surface (light-sensitive layer) by the electrically charging device 500.

In Step ③ (FIG. 3), the front shaft (bearing portion) 301 of the light-sensitive drum 300 is turned to the inlet of the guide groove 903 formed in the side wall of the front-side drum holder 902 keeping a large distance between the drum 300 and the electrically charging device 500. No contact can be occurred between them. After insertion of the front shaft 301 into the guide groove 903, the movement of the light-sensitive drum 300 is regulated by the guide groove 903 so that its external cylindrical surface may approach to the electrically charging device 500 but may not touch with the latter.

When removing the light-sensitive drum 300 from the second process unit 900, above steps are carried out in the reverse order, i.e., Steps ④, ③, ② and ①, thus ensuring the removal of the drum 300 from the unit 900 with no interference with the electrically charging device 500.

The above structure of the second process unit enables the user to mount/demount the light-sensitive drum 300 therein with no fear of damaging the external cylindrical surface of the drum by the electrically charging device 500. This is also accomplished by the structure of the embodiment shown in FIGS. 6 and 7.

The external cylindrical surface of the light-sensitive drum 300 may contact with the cleaning blade 404 and the toner receiving seal 409 while mounting/demounting. Referring to FIGS. 16, 18 and 19, this problem will be discussed below.

Figure 18A:
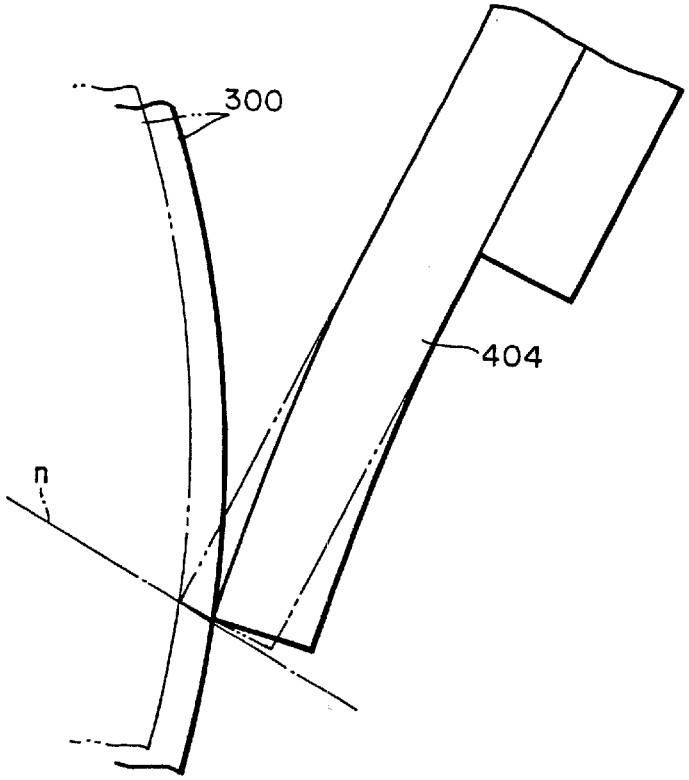
FIGS. 18A and 18B shows a relationship between a surface of a light-sensitive drum and a cleaning blade.
Figure 18B:
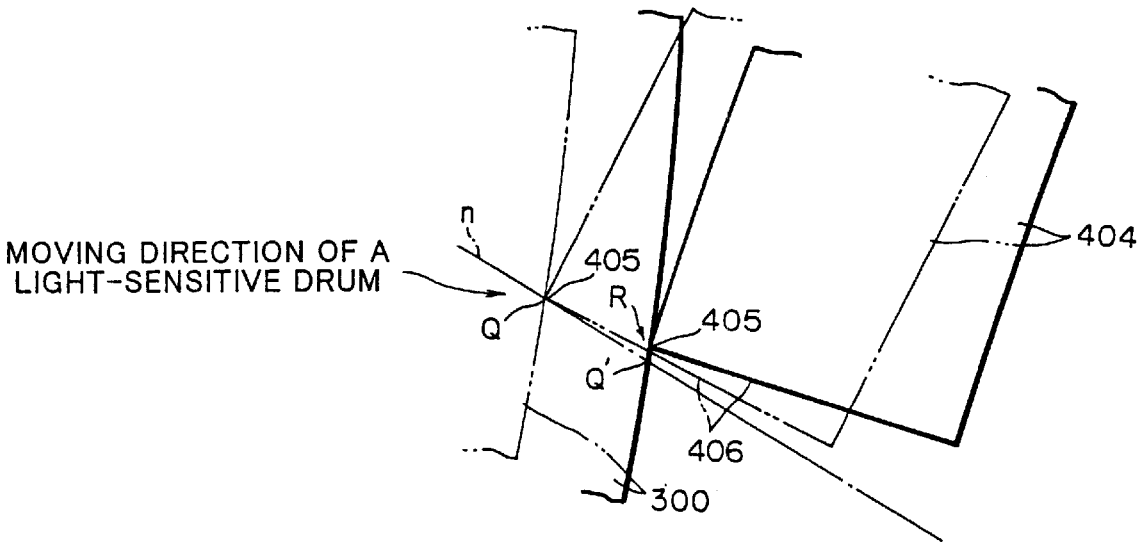

FIGS. 18A and 18B show how the external cylindrical surf ace of the light-sensitive drum 300 moves relative to the cleaning edge 405 of the cleaning blade 404 when mounting the drum 300 in the drum holders.

Figure 19A:
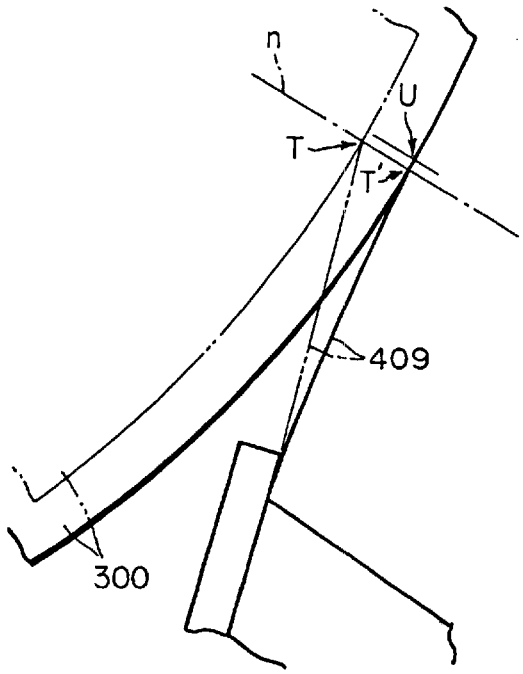
FIGS. 19A and 19B shows a relationship between a surface of a light-sensitive drum and a sealing member for a toner receiver.
Figure 19B:
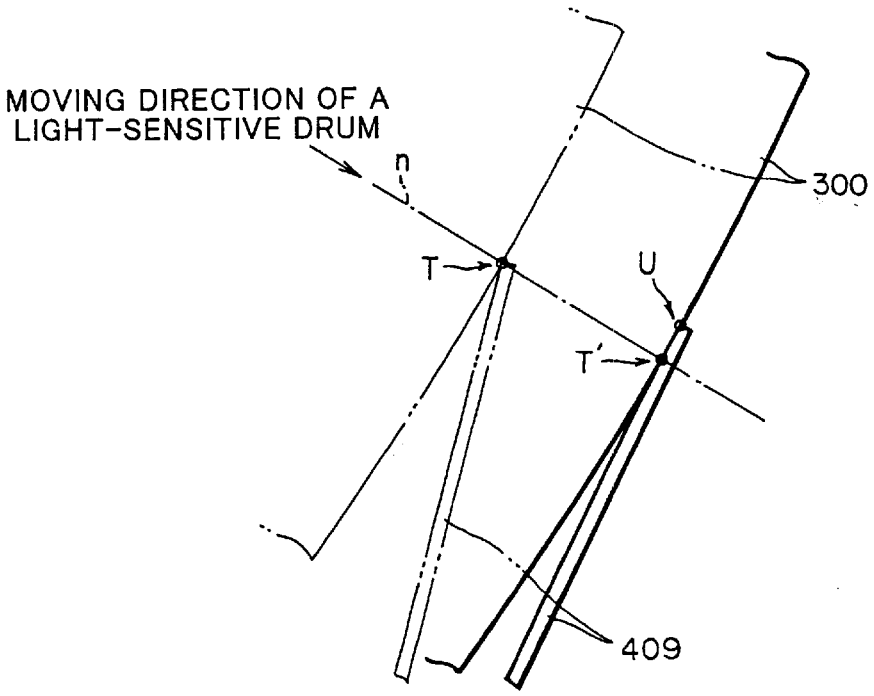

FIGS. 19A and 19B show how the external cylindrical surface of the light-sensitive drum 300 moves relative to a top edge of the toner receiving seal 409 when mounting the drum in the drum holders.

As shown in FIGS. 18A and 18B, the movement of the external cylindrical surface of the light-sensitive drum 300 along a guide groove 903 of the front-side drum holder 902 causes gradual elastic deformation of the cleaning blade 404 for a period from a moment of contacting the cleaning edge 405 with the drum surface to a moment of accomplishing the mounting the drum in the drum holder. For this period, a contact point of the cleaning edge 405 moves on the external cylindrical surface of the light-sensitive drum as shown in enlargement in FIG. 18B (where the moment of putting the cleaning blade edge 405 into contact with the external cylindrical surface of the light-sensitive drum 300 is indicated by a two-dot chain line and the moment of accomplishing the mounting of the light-sensitive drum 300 is indicated by a solid line).

Namely, the contact point Q of the cleaning edge 405 with the external cylindrical surface of the light-sensitive drum 300 moves along a line "n" showing a moving direction of the light-sensitive drum 300 and arrives at a point Q' when the drum 300 is completely mounted. The cleaning edge 405 moves to a contact point R on the external cylindrical surface of the light-sensitive drum 300. Frictional force acting on the cleaning edge 405 is directed from the base side (the cleaning blade holder 402 supporting the cleaning blade 404) to the top edge side (cleaning edge side of the cleaning blade 404). An abutting force of the cleaning edge 405 on the external cylindrical surface of the light-sensitive drum 300 must be large enough to scrap off toner static electrically adhering to the drum surface.

It is also noted that the cleaning blade 404 is made of urethane rubber or the like material possessing a large friction factor to the external cylindrical surface of the light-sensitive drum 300. Considering the above, the direction of mounting/removing the light-sensitive drum into/from the drum holder is regulated by the guide groove 903 so that the friction force may acts in reverse direction from the top edge of the cleaning blade 404 to its base. The force applied to the cleaning edge 405 is increased owing to the large abutting force and friction factor of the blade. This can eliminate the possibility of damaging (wearing or deforming) the cleaning blade edge 405 by friction with the drum surface when mounting/demounting the light-sensitive drum 300. In other words, one can mount/demount the light-sensitive drum 300 in/from the drum holders with no fear of damaging the cleaning edge 405.

In mounting the light-sensitive drum 300, the cleaning edge 405 is brought into contact with the external cylindrical surface of the drum 300 not at a time but in succession from the rear-end to the front-end of the drum since the drum is inserted first at its rear end (bearing 303) into the frame 901 of the second process unit 900.

As shown in FIGS. 19A and 19B, the toner receiving seal 409 is elastically bent with the movement of the external cylindrical surface of the light-sensitive drum 300 along the guide groove 903 for the period from the moment of bringing the seal 409 into contact with the drum 300 surface to the moment of completing the mounting of the drum 300 in the frame. For this period, a contact point of the toner receiving seal 409 moves on the external cylindrical surface of the light-sensitive drum as shown in detail in FIG. 19B (where the moment of putting a top edge of the toner receiving seal 409 into contact with the external cylindrical surface of the light-sensitive drum 300 is indicated by a two-dot chain line and the moment of accomplishing the mounting of the light-sensitive drum 300 is indicated by a solid line). Namely, the contact point T of the top edge of the toner receiving seal 409 with the external cylindrical surface of the light-sensitive drum 300 moves along a line "n" showing a moving direction of the light-sensitive drum 300 and arrives at a point T' when the drum is completely mounted. The top edge of the toner receiving seal 409 moves to a contact point U on the external cylindrical surface of the light-sensitive drum 300. Frictional force acting on the top edge of the toner receiving seal 409 is directed from top edge to the base. The toner receiving seal 401 is made of, e.g., urethane rubber having a relatively large coefficient of friction with the external cylindrical surface of the light-sensitive drum 300. However, this seal 409 is a film lightly abutting against the drum surface since it is not requested to remove toner as the cleaning blade 404 does. Consequently, the toner receiving seal 409 cannot be subjected to damaging of its top edge by friction force acting in the direction from its top edge to the base.

In this instance, the toner receiving seal 409 made of urethane rubber (film) is soft enough not to damage the external cylindrical surface of the light-sensitive drum 300 for a long period of its use in contact therewith. It is also considered that its top edge may not be subjected to friction that may damage its top edge. In case if the toner receiving seal 409 made of different material is used, it should be realized that the seal 409 cannot be damaged when mounting the light-sensitive drum 300 and can be used without being damaged or damaging the drum surface by friction for a long working period. For example, a toner receiving seal 409 made of, e.g., polyethylene terephthalate (PET) being harder and having a smaller friction factor may be used in practice if it is thinner than the urethane seal and abuts on the drum surface at a smaller angle (nearer to a contact plane with the external cylindrical surface of the drum 300 at a contact point) and has no burr at its contact edge (the seal film must be molded at a regulated angle of drawing not to form burrs at edges or it must be cleaned off burrs by buffing).

The edge of the toner receiving seal 409 may be permitted to curve (in contrast to the cleaning edge 405 severely restricted to bend) for the following reason:

As shown in FIG. 9, the cleaning edge 405 of the cleaning blade 404 touches the external cylindrical surface of the light-sensitive drum 300 at a level (line G in FIG. 9) higher than a horizontal plane "h" while the edge of the toner receiving seal 409 touches the drum 300 surface at a level (line F in FIG. 9) lower than the plane "h". Consequently, toner scraped off by the cleaning edge 405 falls into the cleaner housing (on the left from a line j) from a most horizontally projecting position (line H). The toner receiving seal 409 is not intended to scrape off toner but is used for preventing toner particles from leaking out of the cleaner housing. Therefore, it is required to be lightly contacting with the external cylindrical surface.

When demounting the light-sensitive drum 300 from the second process unit 900, it is necessary not to soil the working table surface with toner falling from the drum surface. This is achieved in the following manner:

When the external cylindrical surface of the light-sensitive drum 300 was separated from the cleaning edge 405 of the cleaning blade 404 and an end face of the second seal member 414, toner remaining on the cleaning blade edge 405 and the second seal member 414 may fall out of the cleaner housing and particles may be scattered over the working table surface.

As shown in FIG. 16, when the external cylindrical surface of the light-sensitive drum 300 was separated from the cleaning edge 405 of the cleaning blade 404 and an end face of the second seal member 414, the top edge of the toner receiving seal 409 is still abutting against the external cylindrical surface of the light-sensitive drum 300. As shown in the same Figure, in the completely mounted state of the light-sensitive drum 300, the cleaning edge 405 of the cleaning blade 404 and the end face of the second seal member 414 are located within an area w formed by vertically (in the gravity direction) projecting a cleaner opening 411 of the cleaning device 400 placed on the working table (i.e., an area between a broken line vertically drawn up from the cleaning edge 405 and a broken line vertically drawn up from the top edge of the toner receiving seal 409). Consequently, toner remaining on the cleaning edge 405 of the cleaning blade 404 and the end face of the second seal member 414 can surely fall into the cleaner housing when the light-sensitive drum 300 is removed from or mounted into the second process unit. No toner leaks out of the cleaner housing in both cases.

As described above, the second process unit 900*d* together with other units 900*a*–900*c* are mounted in the same supporting frame 151 of the copier main body 1 and transported to a given position in the direction R therein in FIG. 2. Referring to FIG. 20, methods for locating the light-sensitive drum 300 and connecting it with a driving mechanism when mounting the second process unit 900 in the copier housing 1 are now described below.

Figure 20A:
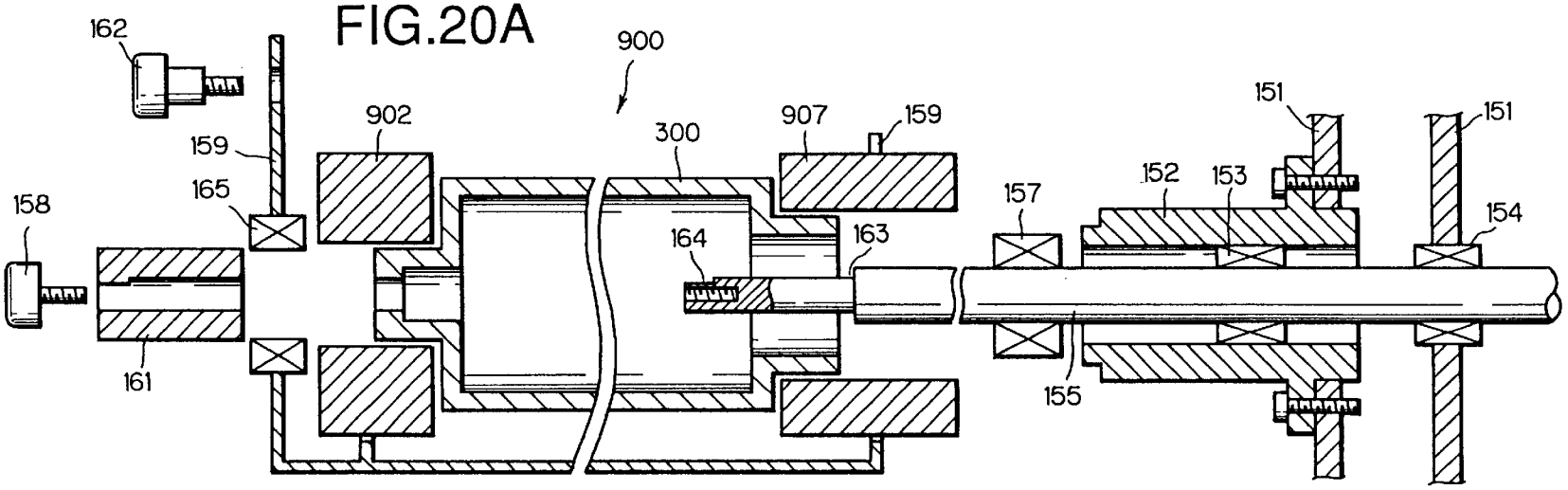
FIGS. 20A and 20B are sectional views of a mechanical connection between a light-sensitive unit and a main body of a copying machine.
Figure 20B:
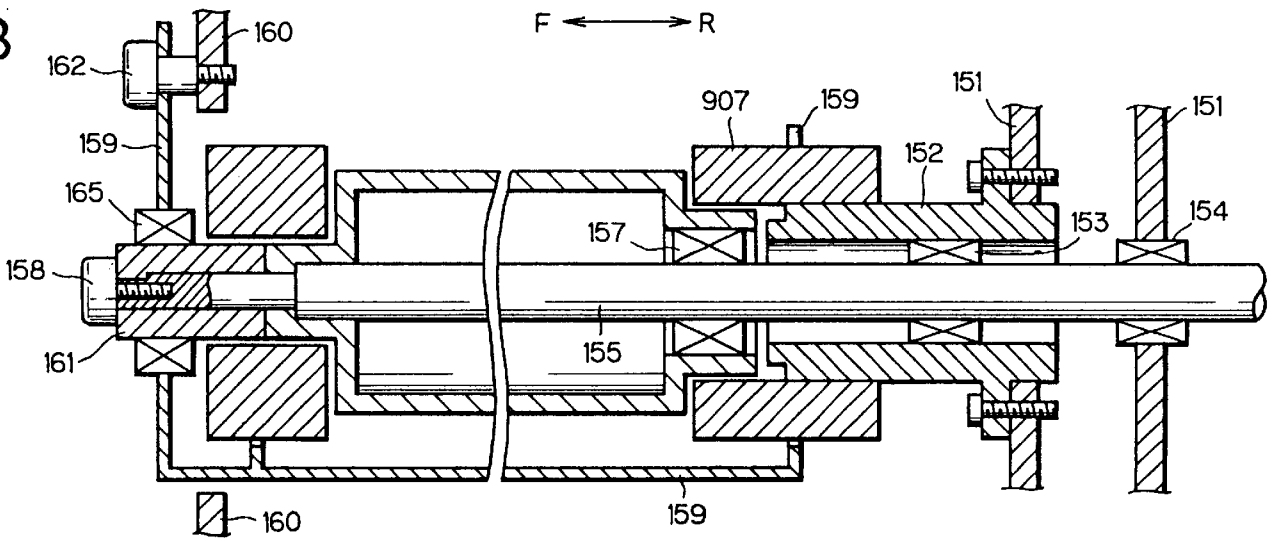

FIG. 20 is a vertical sectional view showing how to engage the second process unit 900 with the copying machine body 1. FIG. 20A shows the second process unit being mounted and FIG. 20B shows the second process unit in the completely mounted state.

As shown in FIGS. 20A and 20B, the second process unit 900 can be removably mounted together with the developing device 600 on a moving frame 159 that can move in the direction F and R along a rear-side frame 151 and a front-side frame 160 as shown in FIG. 20. Mounting or demounting of the second process unit 900 and the developing device 600 is carried out in such a state that a driving shaft 155 of the light-sensitive body exists out of a frame 901 of the second process unit 900 (i.e., with the driving shaft further shifted in the direction R from the shown position (FIG. 20A) to a certain position hereinafter called "mounting/demounting position").

As described before, the light-sensitive drum 300 is supported by a front-side drum holder 902 and a rear-side drum holder 907 of a frame 901 of the second process unit 900 mounted on the moving frame 159.

In this mounting/demounting position, the second process unit 900 and the developing device 600 are mounted on the moving frame 159. When the moving frame 159 with the second process unit 900 and the developing device 600 mounted thereon moves into the copier main body 1 through an opening of the front supporting frame 160, the driving shaft 155 is inserted into the light-sensitive drum 300 through the rear-side drum holder of the second process unit 900. As the moving frame 151 further moves, a locating block 152 secured to the rear-side supporting frame 151 of the copier main body 1 is inserted into a through hole 908 of the rear-side drum holder 907, locating the frame 901 of the second process unit 900 relative to the rear-side supporting 151 of the copier main body 1. At the same time, a bearing 157 secured to the driving shaft 155 is fitted into a rear-side bearing portion 303 of the light-sensitive drum 300 and a stepped portion 163 of the driving shaft 155 is inserted into a front-side bearing portion 301 of the light-sensitive drum 300. In this state, an engaging block 161 is mounted on the F-side end portion of the driving shaft 155 and secured thereto by screwing a screw 158 into a threaded hole in the end face of the driving shaft 155. The front-side bearing portion 301 of the light-sensitive drum 300 is fixed between the engaging block 161 and the stepped portion 301 of the driving shaft 155 (the light-sensitive drum 300) by tightening the screw 158, thus securing the light-sensitive drum 300 is secured onto the driving shaft 155. The moving frame 159 is secured with a fixing screw 162 to the front-side supporting frame 160 of the copier main body 1. Now, the second process unit 900 is completely mounted on the copier main body 1. The light-sensitive drum 300 can be driven in rotation by rotating the driving shaft 155. The light-sensitive drum 300 is supported on the driving shaft 155, thus eliminating the possibility of unstable rotation of the light-sensitive drum. It is separated from the front and rear bearings 301 and 303 of the second process unit.

The second process unit 900 can be demounted by conducting the above steps in the reverse order.

The engaging block 161 is formed to internally fit a partly cut end-portion (D-cut portion) of the driving shaft 155. The driving shaft 155 is rotatably supported by a bearing 154 provided in the rear-side supporting frame 151, a bearing 153 disposed in the locating block 152 and a bearing 168 provided in the moving frame 159.

In the shown embodiment, the locating block 152 is fitted into the through hole 908 of the rear-side drum holder 907 to locate the frame 901 of the second process unit 900 with respect to the copier main body 1. The rear-side drum holder 907 of the second process unit 900 is designed to mount on the locating block 152 and the rear-side bearing portion 303 of the light-sensitive drum 300 and has a sufficient strength with no cut and no slit in its body. It can stably support the second process unit 900. In this regard, the prior art (for example, Japanese Patent Publication No. 63-267989) has a drive-side drum holder having a slit, which has a reduced strength and cannot reliably locate a device and stably support a light-sensitive drum. Therefore, the holder must be elongated to obtain the necessary strength, resulting in elongation of the second process unit in the longitudinal direction.

In the shown embodiment of the present invention, the rear-side drum holder 907 for driving the light-sensitive drum 300 and locating the second process unit 900 accommodate in its through hole 908 the rear-side bearing portion 303 of the light-sensitive drum 300. The front-side drum holder 902, which does not serve as a locator, is designed to mount therein the front-side bearing portion 301 of the light-sensitive drum 300 by using a guide groove 903 provided in it.

Alternatively, the second process unit 900 may be located relative to the copier main body 1 by using a protrusion or the like locating means provided on a side wall of its frame. In this instance, if the rear-side drum holder 907 (for supporting the drum shaft) has no need to work as locating means, the light-sensitive drum 300 can be mounted/demounted into/from the front-side drum holder 902 and the rear-side drum holder 903 by using guide grooves made in both holders. That means no need to use only one side of the rear-side drum holder 903 such as in the front-side drum holder 902 shown as the embodiment.

Figure 21:
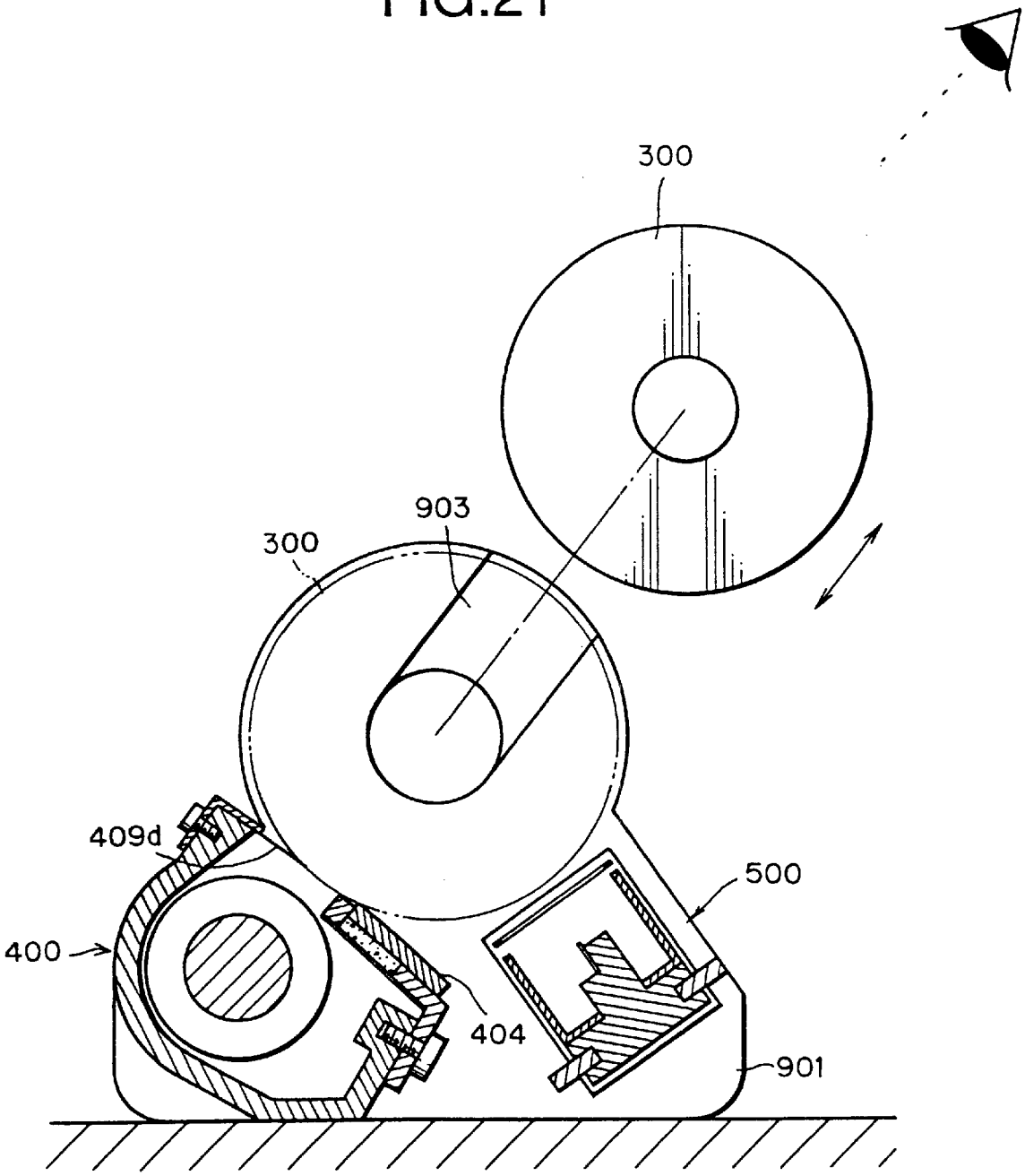
FIG. 21 illustrates a light-sensitive unit according to another aspect (different from that of FIG. 3) of the present invention.

In the shown embodiment, the second process unit 900 can have similar position as mounted in the device on the working table for mounting/demounting the light-sensitive drum 300 in/from the unit 900 as shown in FIG. 9 and 16. A possible alterative is as follows:

FIG. 21 shows an alternative embodiment that differs from the embodiment of FIG. 16 by a position of an electrically charging device 500 on a frame 901 with a cleaning device 400 fixed thereto. On the working table, the process unit 900 has such a position that the cleaning device 400 and the electrically charging device 500 are disposed below and the light-sensitive drum 300 can be mounted/removed into/from the unit 900 from above right.

Figure 22:
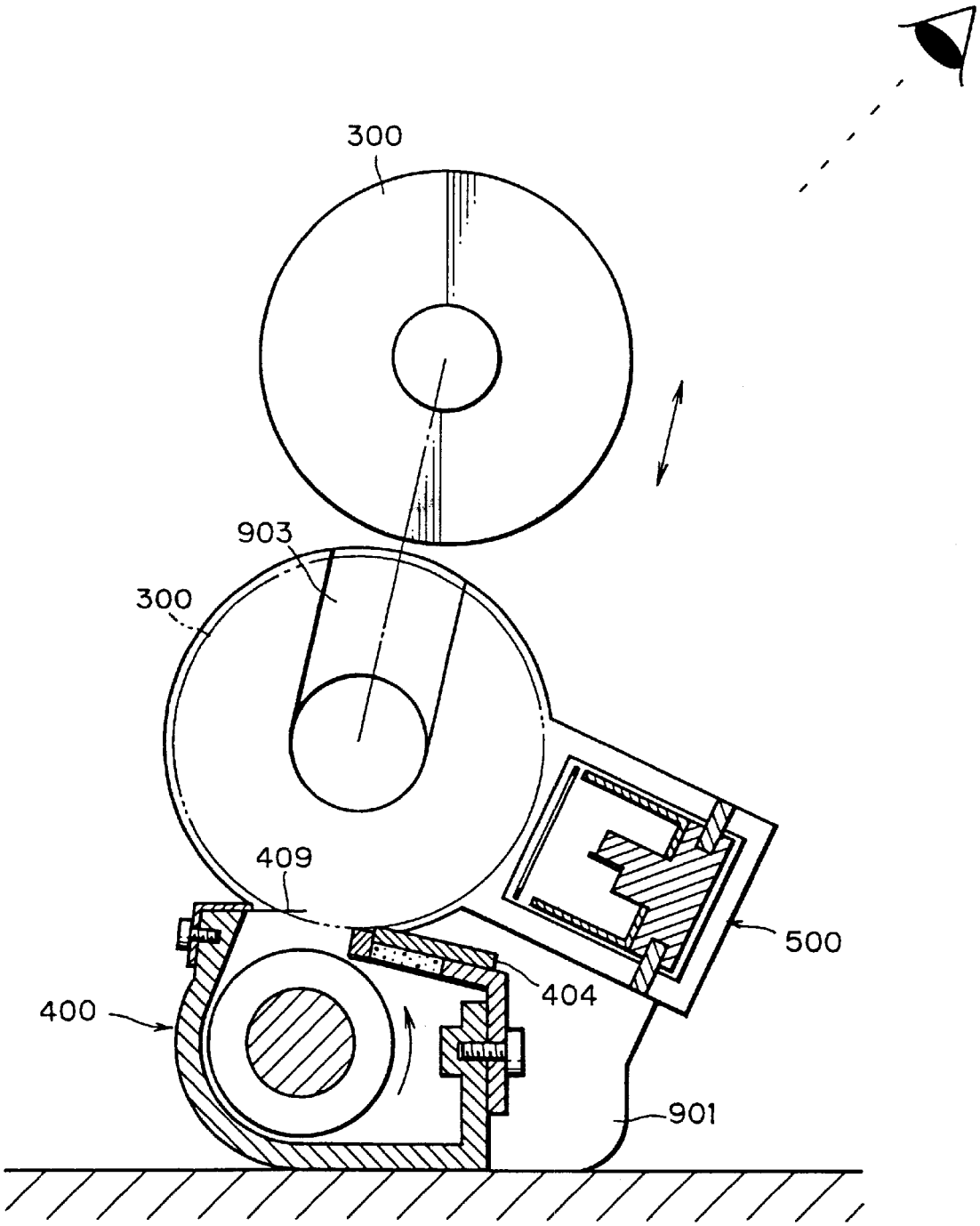
FIG. 22 illustrates a light-sensitive unit according to a further aspect (different from that of FIG. 3) of the present invention.

Another alternative is a second process unit 900 of FIG. 22, which can be placed on the working table in such a state that the cleaning device 400 composing a part of the frame 901 is disposed below and a light-sensitive drum 300 can be mounted/removed into/from the unit 900 from the approximate top.

The second process unit 900 in which a cleaning device 400 and a electrically charging device 500 are integrally provided and which has insufficient stability (due to the internal structure of the cleaning device 400 and the arrangement of the charging device 500) shall be provided with ribs at its base so that it can be stably placed on the working table.

The structure of the light-sensitive unit according to the present invention offers the following advantages:

The light-sensitive drum mounting/demounting structure according to an aspect of the present invention allows one to mount/demount the light-sensitive drum into/from the light-sensitive unit with no fear of damaging its external cylindrical surface by the electrically charging device and the cleaning means disposed around the drum surface owing to the regulating means for preventing the drum from coming into contact with the above devices.

The light-sensitive drum mounting/demounting structure according to another aspect of the present invention is capable of regulating the movement of the supporting shaft of the light-sensitive drum by the regulating means disposed in the drum holder. This regulating means may be set in accord with the movement of the supporting shaft. The regulating means can be simplified and miniaturized.

The light-sensitive drum mounting/demounting structure according to another aspect of the present invention has a bearing portion projecting from the drum holder, which serves as regulating means for preventing the excessive movement of the supporting shaft of the light-sensitive drum and makes it easier to insert the one end of the supporting shaft into a through hole made in the drum holder. This eliminates the possibility of damaging a cleaning blade, toner receiving seal and the like parts disposed around the drum holder by an edge of the light-sensitive drum and damaging the external cylindrical surface of the light-sensitive drum by the above surrounding members.

The light-sensitive drum mounting/demounting structure according to a further aspect of the present invention has a mounting frame having a notch adjacent to a space allowing the light-sensitive drum to pass through when it is mounted or demounted. This notch gives refuge to user's fingers holding the light-sensitive drum to be mounted or demounted. The light-sensitive drum having a small diameter relative to the frame may be easily mounted/removed into/from the frame by using the notch.

The light-sensitive drum mounting/demounting structure according to a still further aspect of the present invention has a drum holder with a stopper removably mounted therein and a mounting/demounting guide formed therein with the stopper removed, thereby a supporting shaft of the drum can be easily mounted/demounted into/from the drum holder by using the guide.

The present invention provides a light-sensitive unit provided with above drum mounting/demounting structure, which can reliably mount/demount the light-sensitive drum.

According to another aspect of the present invention, the light-sensitive drum can be mounted/demounted with no fear of damaging light-sensitive surface of the drum and the cleaning edge. The cleaning device can stably clean off toner. The light-sensitive drum can be easily mounted/demounted into/from the light-sensitive unit with no fear of damaging the drum since it cannot contact the electrically charging device mounted on the unit.

According to another aspect of the present invention, the rear-side drum holder on the driving side has no slit and possesses structural strength enough to stably support the light-sensitive drum. The drum can be easily mounted/demounted into/from the drum holder.

According to a further aspect of the present invention, the used light-sensitive unit can be removed with no fear of soiling the working table with toner particles falling out of the cleaning housing. The drum is easily mounted into the light-sensitive unit, because user can look down at the drum at a slant. The conditions of cleaning blade and the toner receiving seal can be easily observed.

According to still further aspect of the present invention, the light-sensitive unit can be reliably located to a given position in an image-forming device by using a locating block provided in the image-forming device and can be reliably supported therein.

According to another aspect of the present invention, the light-sensitive unit comprising a cleaning device, a light-sensitive drum and an electrically charging device can be used in an image-forming device. The light-sensitive drum and the electrically charging device can be replaced after the light-sensitive unit is removed from the image- forming device. This assures easy maintenance of the image-forming device.

What is claimed is:

1. A light-sensitive drum structure for removably supporting on a frame a light-sensitive drum carrying a latent image formed thereon comprising:

a light-sensitive drum structure, with structure members disposed around the light-sensitive drum, and the frame including means for regulating to prevent a surface of the light-sensitive drum from coming into contact with the structure members when the light sensitive drum is mounted on the frame, the light-sensitive drum structure can be mounted or dismounted, the frame has a pair of holders disposed opposite to each other, the pair of holders respective end shafts provided on both ends of the light-sensitive drum and the regulating means restricts movement of the end shafts of the light-sensitive drum, wherein one holder of the paired holders has a through hole made therein for insertion of the end shaft of the light-sensitive drum and the regulating means is formed as an axially protruded bearing portion of an inner wall part of the through hole to receive the end shaft of the light-sensitive drum.

2. A light-sensitive drum structure for removably supporting on a frame a light-sensitive drum carrying a latent image formed thereon according to claim 1, wherein the frame has a notch formed therein for giving refuge to user's finger holding the light-sensitive drum in a position close to a space allowing the light-sensitive drum pass through when mounting or demounting the light-sensitive drum therein or therefrom.

3. A light-sensitive drum mounting/demounting structure as defined in claim 1, wherein another holder of the paired holders has a detachable stopper and forms, with the stopper removed, a guide for guiding the end shaft of the light-sensitive drum when mounting/demounting the light-sensitive drum.

4. A light-sensitive drum provided with a light-sensitive drum structure of claim 1.

5. An image-forming device which is provided with a light-sensitive drum structure defined in claim 1.

6. A light-sensitive unit having a frame for unitarily supporting a removable light-sensitive drum, a cleaning device for scraping off toner from a surface of the light-sensitive drum by its cleaning blade abutting thereon and an electrically charging device, wherein a frictional force acting on a cleaning edge of the cleaning blade abutting against an external cylindrical surface of the light -sensitive drum when mounting the light-sensitive drum in the frame is directed from a supporting body of the cleaning blade to the cleaning edge and the light-sensitive drum is mounted in the frame from the direction in which the light-sensitive drum has no interference with the electrically charging device.

7. A light-sensitive unit as defined in claim 6, wherein the light-sensitive unit has a frame base by which it is placed on a working table in a position allowing the light-sensitive drum to be mounted/removed in/from the light-sensitive unit from a substantially upper diagonal direction.

8. An image-forming device which is provided with a light-sensitive unit defined in claim 6.

* * * * *